US007712168B2

(12) United States Patent
Kim

(10) Patent No.: US 7,712,168 B2
(45) Date of Patent: May 11, 2010

(54) ARTICULATING BED AND METHOD OF USING THE SAME

(76) Inventor: Willie W. Kim, 2124 W. Cherrywood La., Anaheim, CA (US) 92804

( * ) Notice: Subject to any disclaimer, the term of this patent is extended or adjusted under 35 U.S.C. 154(b) by 0 days.

(21) Appl. No.: 11/859,701

(22) Filed: Sep. 21, 2007

(65) Prior Publication Data

US 2009/0077744 A1 Mar. 26, 2009

(51) Int. Cl.
*A47B 7/02* (2006.01)

(52) U.S. Cl. ..... 5/613; 5/185; 5/608; 5/942; 5/943

(58) Field of Classification Search ..... 5/613, 5/617, 618, 607–610, 81.1 HS, 81.1 R, 181, 5/185, 600, 934, 942, 943
See application file for complete search history.

(56) References Cited

U.S. PATENT DOCUMENTS 2,113,286 A * 4/1938 White ..... 5/607
4,760,615 A * 8/1988 Furniss ..... 5/611
5,090,071 A 2/1992 Bathrick et al.
5,468,216 A 11/1995 Johnson et al.
5,699,566 A * 12/1997 Chuang ..... 5/613
6,357,065 B1 * 3/2002 Adams ..... 5/618
6,360,386 B1 3/2002 Chuang
6,851,144 B2 * 2/2005 Wang ..... 5/610
6,907,625 B2 * 6/2005 Nomura ..... 5/81.1 HS

FOREIGN PATENT DOCUMENTS

WO WO 03073973 A1 2/2003

* cited by examiner

*Primary Examiner*—Peter M Cuomo
*Assistant Examiner*—Nicholas Polito
(74) *Attorney, Agent, or Firm*—Knobbe Martens Olson & Bear LLP

(57) ABSTRACT

Disclosed are an articulating bed and methods of using the bed. The articulating bed includes a top frame and one or two underlying frames. The top frame includes a first side section and a second side section. One of the side sections is configured to slide in a lateral direction of the bed so as to vary a width of the bed. Further, the sections are configured to hingedly rotate. Various methods include sliding and hingedly rotating the side sections. Further, the methods includes sitting up a person lying on the bed and changing liners while the person is staying on the bed, using the sliding and hinged rotation features.

24 Claims, 32 Drawing Sheets

ARTICULATING BED AND METHOD OF USING THE SAME

BACKGROUND

1. Field

The present disclosure relates to a bed, and more particularly, pertains to an articulating bed.

2. Discussion of Related Technology

A typical bed includes a frame and a mattress placed over the mattress. Some beds have two or more sections that are bendable relative to each other. Some of these bendable beds are powered by electric motors and change between the flat (lying) configuration and the bent (sitting) configuration. These powered bending beds are typically used in hospitals and nursing homes.

SUMMARY

One aspect of the invention provides a bed, which comprises: a first frame comprising a first side section and a second side section; a second frame supporting the first frame; and wherein a first side section is configured to slide in a lateral direction of the bed so as to vary a width of the bed.

In the foregoing bed, the first side section and the second side section may be coupled together and configured to slide together. In a first configuration of the bed, the first frame may substantially eclipse the second frame when viewed from the top, and the bed has a first width, and wherein in a second configuration of the bed, a substantial portion of the second frame may be exposed when viewed from the top, and the bed has a second width, which is larger than the first width. In the first configuration, the first and second sections may define a mattress support area over which a mattress is to be supported, and wherein in the second configuration, the exposed portion of the second frame and the first and second sections may together define the mattress support area over which a mattress is to be supported.

Still in the foregoing bed, the second side section may be configured to remain still or slide in the lateral direction independent of the first side section. The first and second side sections may be configured to slide relative to each other between a first relative position and a second relative position, wherein in the first relative position, the first and second side sections may be located the closest with each other, wherein in the second relative position the first and second side sections may be the most remotely located from each other, and wherein in the second relative position. a mattress support area may be larger than in the first relative position. The second frame may comprise a slider and a sliding guide, wherein the slider may be slidably engaged with the sliding guide and may be configured to slide generally in the lateral direction, wherein the slider may be attached to the first side section such that sliding of the first side section is guided by the sliding guide of the second frame. The bed may further comprise a hinge having a hinge axis and hingedly interconnecting the first side section and the slider, wherein the first side section may be configured to hingedly rotate about the hinge axis. The bed may further comprise a sliding mechanism configured to power sliding of the first section.

Further in the foregoing bed, the first side section may comprise a first side rail generally extending in a longitudinal direction of the bed, wherein the first side section may be further configured to hingedly rotate about a first axis generally parallel to the longitudinal direction such that the first side rail is lifted. The bed may further comprise a hinge hingedly connecting between the first side section and the second frame, wherein the first side section may be configured to hingedly rotate via the hinge. The bed may further comprise a lifting mechanism configured to power hinged rotation of the first section.

The bed may further comprise an actuating device configured to power both sliding and hinged rotation of the first section. The actuating device may comprise a driving rod, a first traveling nut and a second traveling nut, wherein the driving rod may extend generally in the lateral direction and configured to rotate, wherein the first and second traveling nuts may be engaged with the driving rod and configured to travel along the driving rod as the driving rod rotates. The first traveling nut may be connected to the first side section and configured to power sliding of the first side section in the lateral direction while traveling along the driving rod. The driving rod may comprise a threaded portion and two non-threaded portion at both ends of the threaded portion, wherein the first and second traveling nuts may be configured to travel along the driving rod while engaged with the threaded portion, wherein the first and second traveling nuts may be configured to stop traveling when reaching the non-threaded portion. The first traveling nut may be configured to power hinged rotation of the first side section while traveling along the driving rod if the second traveling nut reaches the non-threaded portion.

Another aspect of the invention provides a bed, which comprises: a first frame; a second frame underlying the first frame, wherein the first frame is configured to slide relative to the second frame between a first position and a second position; and a sliding mechanism configured to power sliding of the first frame between the first position and the second position, wherein in the first position, the first frame substantially eclipses the second frame when viewed from the top, and wherein in the second position, a substantial portion of the second frame is exposed when viewed from the top.

Still another aspect of the invention provides a bed, which comprises: a first frame comprising a first section and a second section, the first section comprising a first side rail, the second section comprising a second side rail, wherein the first side rail is arranged to be generally linear with the second side rail; and a lifting bar comprising a first lifting segment and a second lifting segment hingedly connected with the first lifting segment, wherein the first lifting segment and second lifting segment are configured to hingedly rotate relative to each other about a first axis such that the first section and the second section hingedly rotate relative to each other about the first axis, wherein the first lifting segment is engaged with the first side rail, wherein the second lifting segment is engaged with the second side rail, wherein the first lifting segment and the second lifting segment are in combination configured to hingedly rotate the first side rail and the second side rail about a second axis substantially perpendicular to the first axis.

A further aspect of the invention provides a method of operating a bed, which comprises: providing a bed comprising a first frame and a second frame underlying the first frame, wherein the bed comprising a mattress support area configured to support a mattress, wherein the mattress support area has a width, which is a distance between two ends of the bed in a lateral direction; and sliding the first frame relative to the second frame in a lateral direction of the bed so as to vary the width.

DETAILED DESCRIPTION OF EMBODIMENTS

Various features and advantages of the invention will be described in terms of embodiments and examples with reference to the foregoing drawings. Those having ordinary skill in the art may be able to make alterations and modifications what is described herein without departing from its spirit and scope. Therefore, it must be understood that what is illustrated and described herein is set forth only for the purposes of example and that it should not be taken as a limitation.

Figure 1:
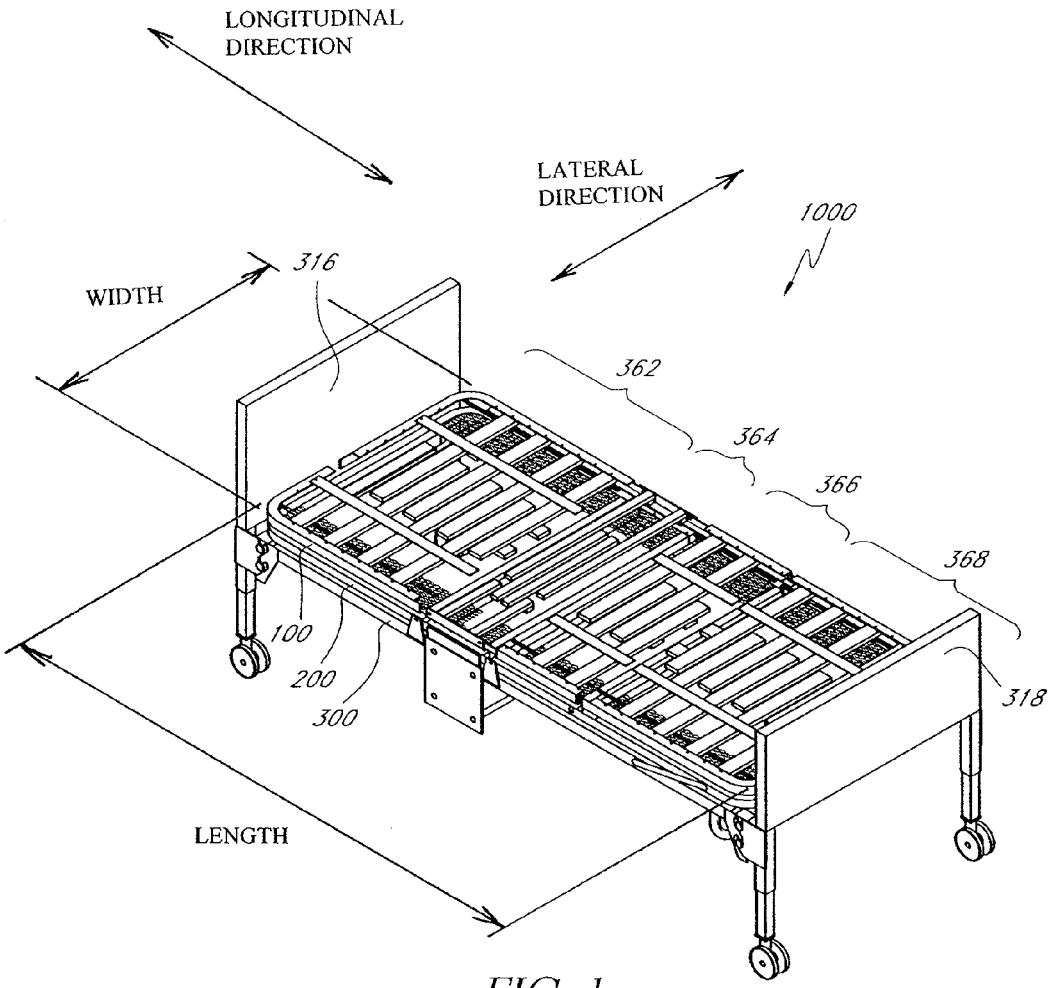
FIG. 1 is a bird-eye view of an articulating bed according to an embodiment of the invention.
Figure 2:
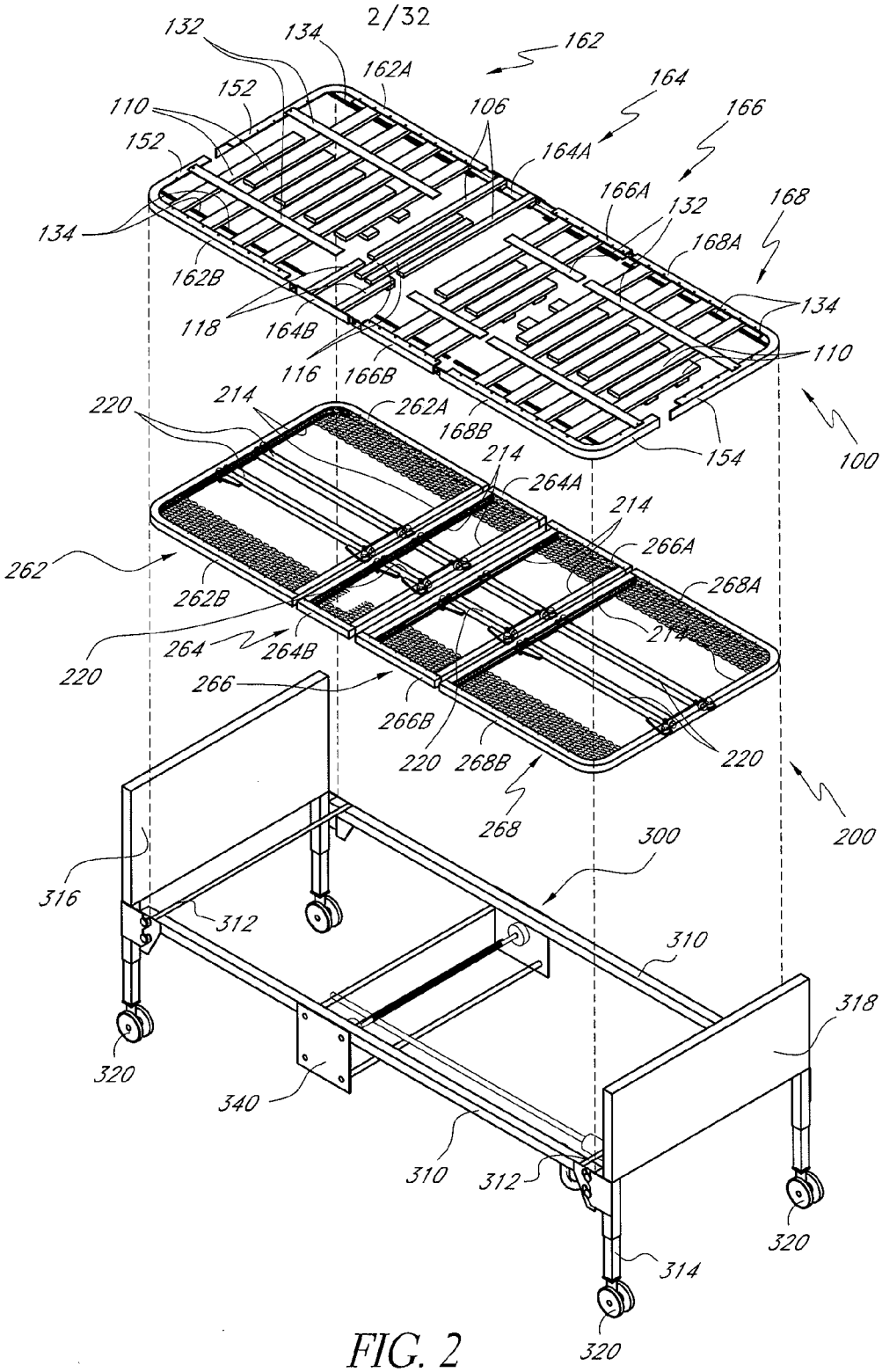
FIG. 2 is an exploded view of the bed in FIG. 1, illustrating a top frame, an intermediate frame, and a base frame.

Referring to FIGS. 1, and 2, an articulating bed 1000 according to an embodiment includes a top frame 100, an intermediate frame 200, and a base frame 300. The top frame 100 is placed over the intermediate frame 200, which is placed over the base frame 300. In other embodiments, the bed 1000 may include one or more additional frames (not illustrated). Further, in other embodiments, it is not necessary that the articulating bed include all of the top, intermediate and base frames 100, 200, 300. The bed 1000 can be constructed in any sizes including twin, full, long twin, queen, king and California king beds.

The bed 1000 optionally includes a head board 316 and a foot board 318. The bed 1000 further includes a head section 362, a hip section 364, an upper leg section 366 and a lower leg section 368. Each of these sections 362, 364, 366 and 368 refer to collectively a portion of the top frame 100 and a portion of the intermediate frame 200, although it could include a portion of base frame 300 in certain other embodiments. As shown in FIG. 1, the longitudinal directions of the bed are the direction along the head section 363, hip section 364, upper leg section 366 and lower leg section 368. The lateral directions of the bed are perpendicular to the longitudinal directions. The distance between the two ends of the bed in the longitudinal direction is defined as the "length" of the bed. The distance between the two ends of the bed in the lateral direction is defined as the "width" of the bed.

In the illustrated embodiment, the articulating bed 1000 is configured to allow the top frame 100 or its portion(s) to slide sideways (in the lateral direction) over the intermediate frame 200. Further, a portion of the top frame 100 is configured to be lifted. Moreover, the head, hip, upper leg and lower leg sections 362, 364, 366, 368 are configured to bend with respect to the others. These sliding, lifting and bending features of the bed 1000 will be described in more detail.

In this disclosure, the terms "right" and "left" refer to the right and left sides of a person lying on the bed with the head over the head section 362 and the legs over the leg sections 366, 368 of FIG. 1. Thus, these terms "right" and "left" do not necessarily refer to certain illustrated features that are located on the right-hand or left-hand side of the drawing sheets.

Top Frame

The top frame 100 includes a head section 162, a hip section 164, an upper leg section 166, and a lower leg section 168, which correspond to the head section 362, hip section 364, upper leg section 366 and lower leg section 368, respectively. The top frame 100 includes left side rails 162A, 164A, 166A, 168A, right side rails 162B, 164B, 166B, 168B, head rails 152 and foot rails 154, which in combination generally define the lying area of the bed 1000. The top frame 100 further includes a plurality of mattress support bars 110, 106, 116, 118 that are to support a mattress to be placed over them.

Each of the head section 162, upper leg section 166 and lower leg section 168 is formed by some of the mattress support bars 110, the left side rails 162A, 166A, 168A, and the right side rails 162B, 166B, 168B. The mattress support bars 110 of the head, upper leg and lower leg sections 162, 166, 168 are generally in the same shape, though not necessary. Some of the mattress support bars 110 are fixed to the right side rails 162B, 166B, 168B, and the others are fixed to the left side rails 162A, 166A, 168A. As illustrated, for example, the mattress support bars 110 are attached to the left and right side rails 162A, 166A, 168A, 162B, 166B, 168B staggeringly.

As will be discussed later, the hip section 364, 164 of the bed 1000 is used in actuating the sliding and lifting operations of the bed 1000. For this reason, the left side rail 164A and the right side rail 164B of the hip section 164 are slightly differently shaped from the other left and right side rails 162A, 166A, 168A, 162B, 166B, 168B. The hip section 164 includes mattress support bars 106, 116, 118, which are slightly differently shaped and arranged from the other mattress support bars 110; however, these differences may not be necessary.

In other embodiments, one or more of the other sections 362, 366, 368 in addition to the hip section 364 can be used in actuation of the sliding and lifting operations, and the shapes and arrangements of their components can be configured accordingly. Also, in other embodiments, one or more of the other sections 362, 366, 368 can be used in the actuation of the sliding and lifting operations in replacement of the hip section 364, and the shapes and arrangements of their components can be configured accordingly.

In the illustrated embodiment, several straps 132, 134 are formed crossing the mattress support bars 110 of the head, upper leg and lower leg sections 162, 166, 168. Each strap 132, 134 combines two or more mattress support bars 110, which are attached to the same side rail and further belonging to a single section 162, 166 or 168. These mattress support bars 110 combined by a strap 132, 134 are to move together in the sliding, lifting and being operations. Although not illustrated, if needed, one or more straps may be formed on the mattress support bars 106, 116 to combine them. The straps 132, 134 can be replaced with other appropriate means or forms of combining two or more mattress support bars. In some embodiments, some of the mattress support bars 106, 110, 116, 118 are replaced with a board or plate for supporting mattress, in which combining straps may not be needed.

Intermediate Frame

The intermediate frame 200 includes a head section 262, a hip section 264, an upper leg section 266, and a lower leg section 268, which respectively correspond to the head section 362, hip section 364, upper leg section 366 and lower leg section 368 of the articulating bed 1000. The intermediate frame 200 is composed of left side bars 262A, 264A, 266A, 268A, right side bars, 262B, 264B, 266B, 268B, and roller guide bars 214 interconnecting the left and right side bars. In the illustrated embodiment, each section 262, 264, 266, 268 of the intermediate frame 200 is generally defined by two opposing side bars and two opposing roller guide bars.

Further, each section 262, 264, 266, 268 includes two slidable hinge support bars 220, which are arranged substantially parallel, although not limited thereto. The opposing ends of each slidable hinge support bar 220 are slidably engaged with two opposing roller guide bars 214 of each section 262, 264, 266, 268, which will be discussed later in detail. In some embodiment, the slidable hinge support bars 220 of each intermediate frame section are interconnected with the slidable hinge support bars 220 of neighboring intermediate sections, although not limited thereto. The interconnection between the slidable hinge support bars 220 of the neighboring intermediate sections facilitates sliding operation of the top frame, which will be discussed later.

Base Frame

The base frame 300 supports the top and intermediate frames 100, 200. The base frame 300 includes two substantially parallel side bars 310 and two substantially parallel head/foot bars 312. In the illustrated embodiment, although not necessary, the base frame 300 is supported by four legs 314 with wheels 320, and a head board 316 and foot board 318 are connected to the base frame 300 so as to provide a basic configuration of a bed. Further, the base frame 300 anchors the sliding and lifting mechanism 340, which will be further discussed in detail.

Connections Among the Top Frame Sections

Figure 3A:
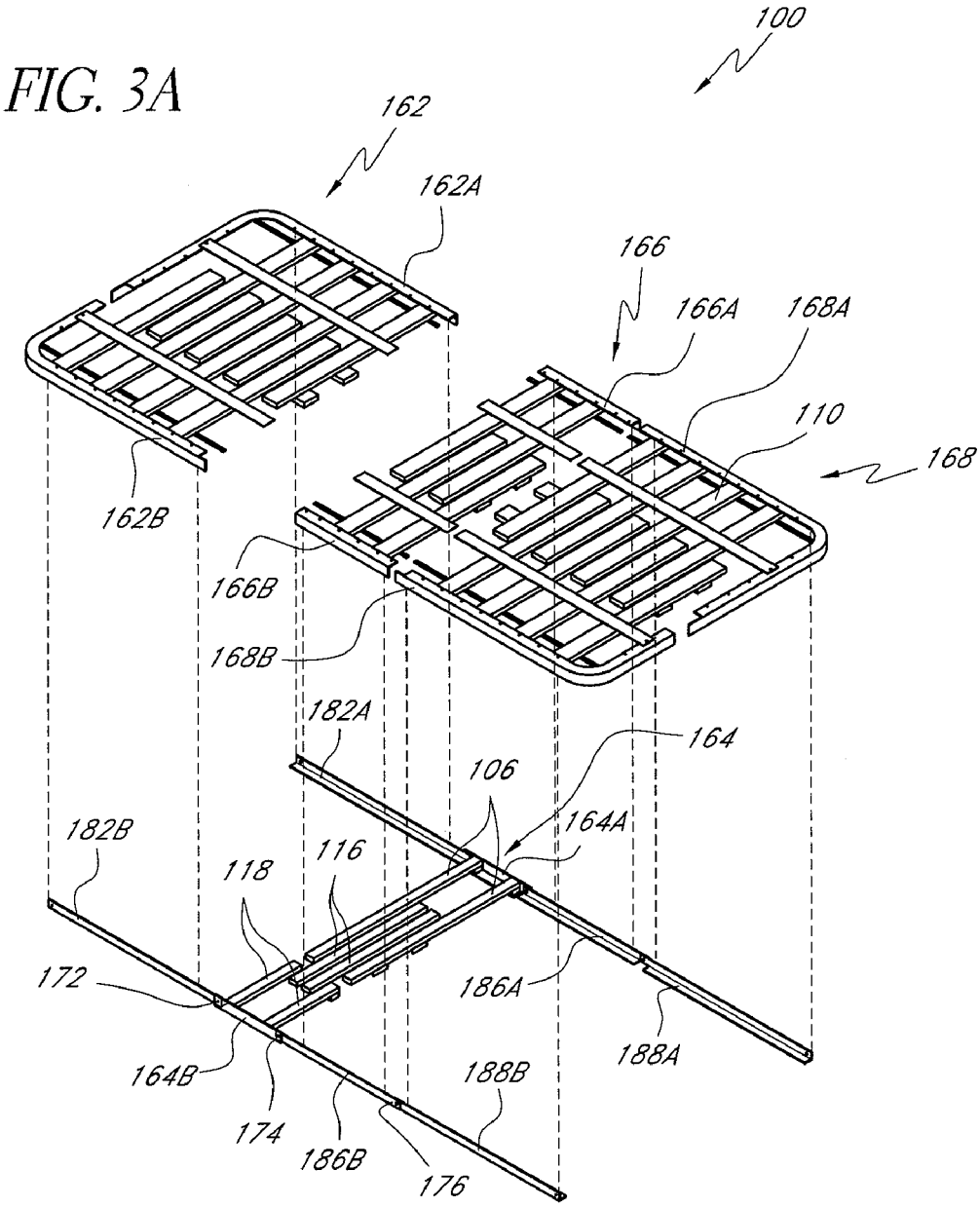
FIG. 3A is an exploded view of the top frame.
Figure 3B:
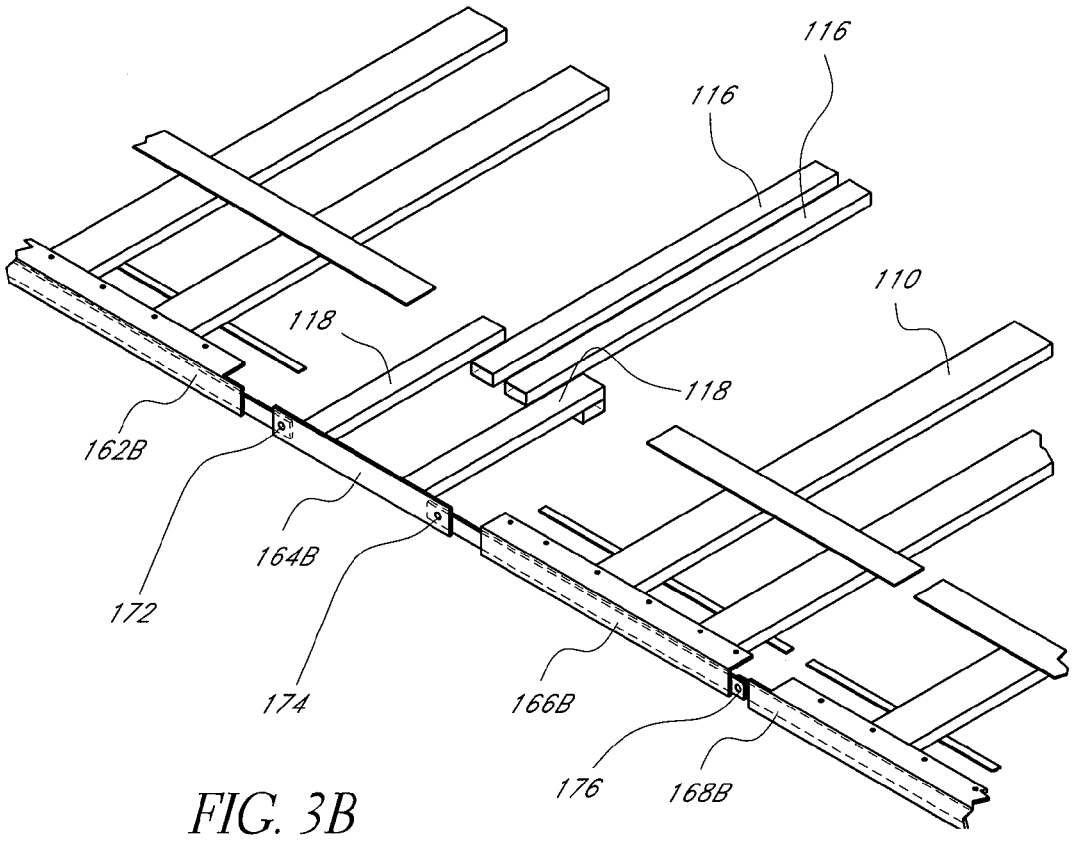
FIG. 3B illustrates the engagement of components of the top frame in FIG. 3A.

FIGS. 3A and 3B illustrate an embodiment of connections among the top frame sections. In the illustrated embodiment, extensions 182A, 186A, 188A, 182B, 186B, 188B are connected to the left and right side rails 164A, 164B of the hip section 164 of the top frame 100. The extension 182A is hingedly connected to the left side rail 164A of the hip section 164 at a joint 172. The extension 186A is hingedly connected to the left side rail 164A at a joint 174. Similarly, the extensions 182B, 186B are hingedly connected to the left side rail 164B of the hip section 164. The extension 188A is hingedly connected to the extension 186A at a joint 176, and the extension 188B is also hingedly connected to the extension 186B. These hinged connections allows each extension 182A, 186A, 188A, 182B, 186B, 188B to bend relative to its neighboring extension and accordingly allows each section 162, 164, 166, 168 to bend relative to its neighboring section.

Each of the left and right side rails 162A, 166A, 168A, 162B, 166B, 168B has a generally L-shaped cross-section, although not limited thereto. The L-shaped cross-section of the side rails facilitate that the extensions 182A, 186A, 188A, 182B, 186B, 188B are received by and engaged with these side rails from the underside. More specifically, the extension 182A is received by the left side rail 162A, the extension 186A is received by the left side rail 166A, and the extension 188A is received by the left side rail 168A. Likewise, the extensions 182B, 186B, 188B are received by the right side rails 162B, 166B, 168B, respectively.

Hinged Connection Between Top and Intermediate Frames

Figure 4A:
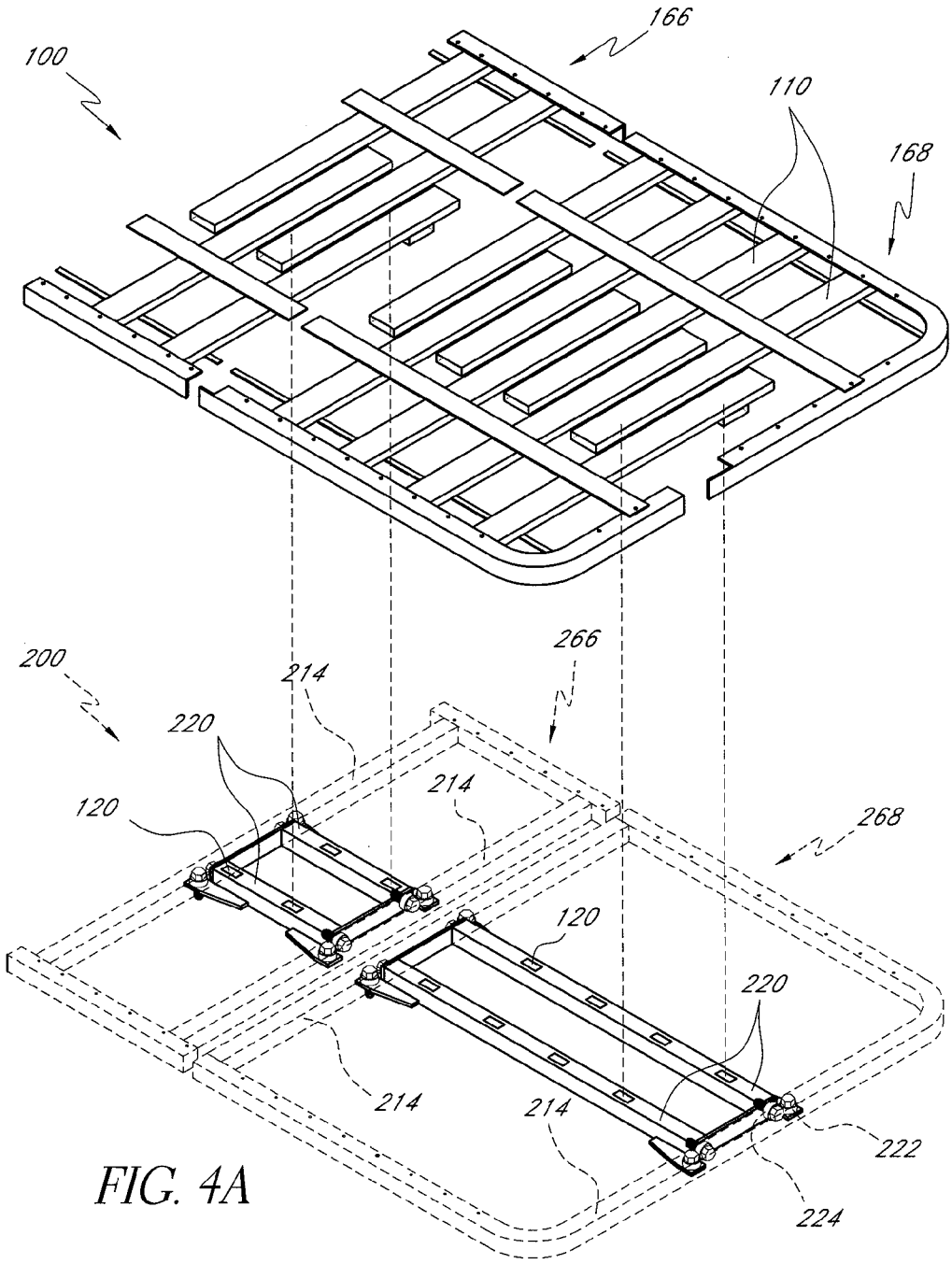
FIG. 4A illustrates the engagement between the top frame and the intermediate frame.
Figure 4B:
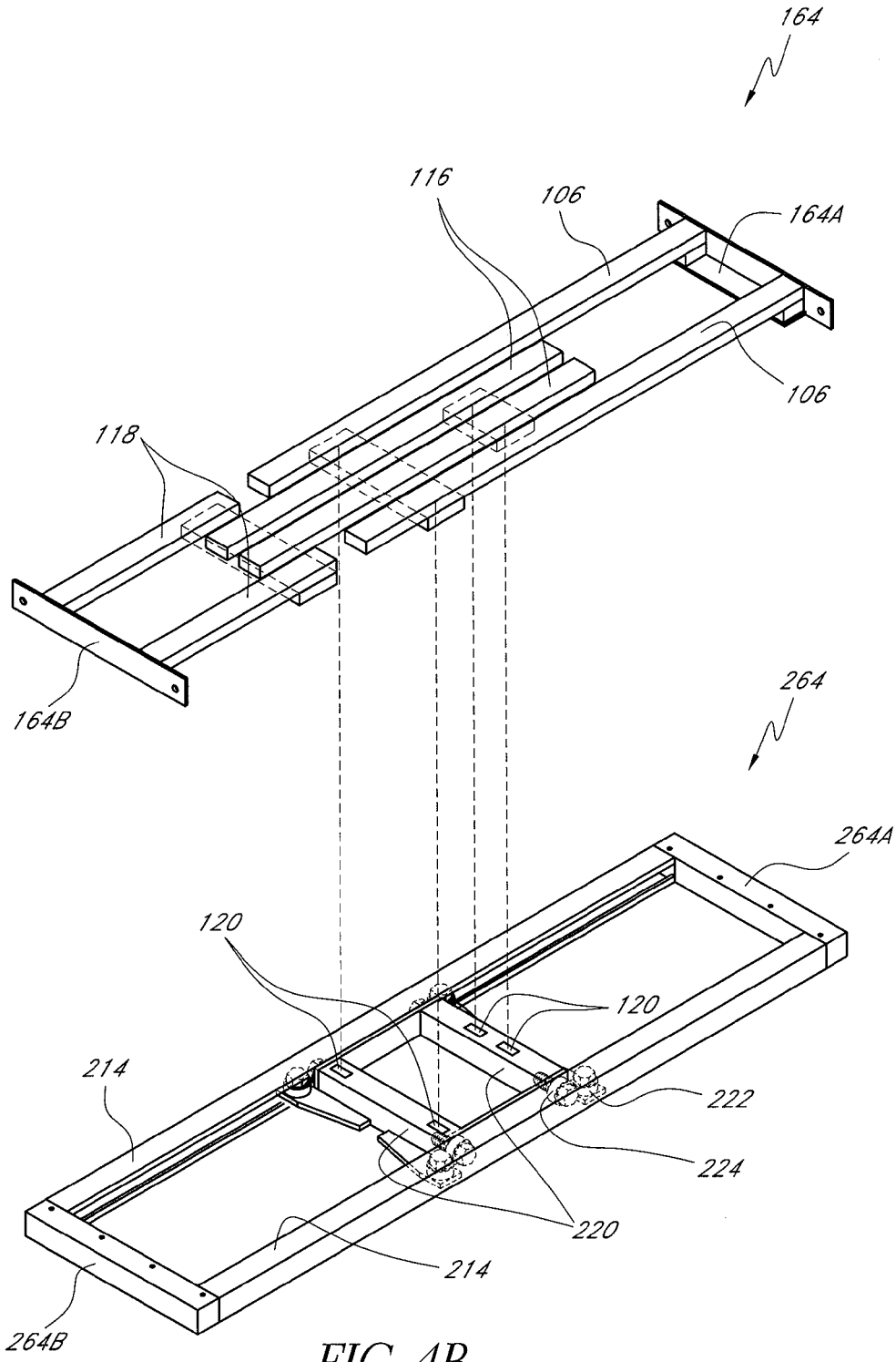
FIG. 4B further illustrates the engagement between the top frame and the intermediate frame.
Figure 4C:
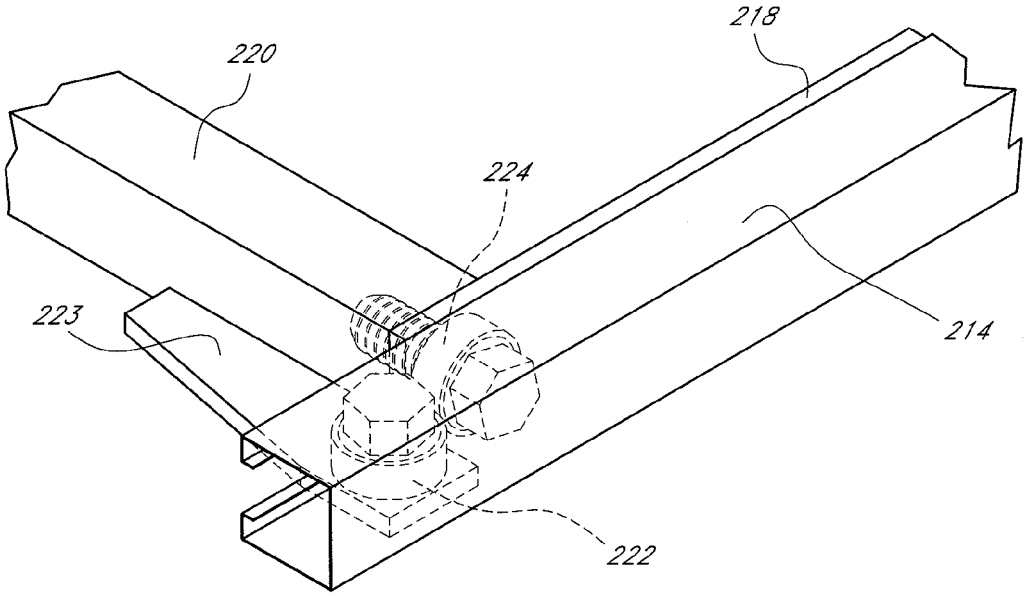
FIG. 4C illustrates the engagement between a slidable hinge support bar and a roller guide bar of the intermediate frame.

FIG. 4A illustrates an embodiment of the connection between the upper leg section 166 of the top frame 100 and the upper leg section 266 of the intermediate frame 200, and further illustrates an embodiment of the connection between the lower leg section 168 of the top frame 100 and the lower leg section 268 of the intermediate frame 200. FIG. 4B illustrates an embodiment of the connection between the hip section 164 of the top frame 100 and the hip section 264 of the intermediate frame 200. Each of the top frame sections is connected to the corresponding section of the intermediate frame 200 via the slidable hinge support bars 220.

Hinges 120 are formed on each of the slidable hinge support bars 220, facing the top frame 100. Each hinge 120 is interposed between the slidable hinge support bar 220 and one of the mattress support bars 110, 106, 116, 118 and forms a hinged connection therebetween. With the hinged connection, each mattress support bar is rotatable about the axis of the hinge, as will be discussed further.

Slidable Connection Between Top and Intermediate Frames

In embodiments, the slidable hinge support bars 220 are slidably engaged with the roller guide bar 214. Since the intermediate frame 200 are connected to top frame 100 via the above-discussed hinged connection, as the slidable hinge support bars 220 slide relative to the roller guide bars 214, the top frame 100 and the intermediate frame 200 are to slide relative to each other.

Referring to FIGS. 4A and 4B, two opposing ends of each slidable hinge support bar 220 are engaged with two roller guide bars 214. In the illustrated embodiments, each end of the slidable hinge support bar 220 has horizontal and vertical rollers 222, 224, which connect with the roller guide bar 214. The horizontal roller 222 is supported by a horizontal roller support 223, which is attached to the slidable hinge support bar 220 near its end facing the roller guide bar 214. The vertical roller 224 is directly connected to the end of the slidable hinge support bar 220. On the other hand, the roller guide bar 214 has a guide channel in its hollow body.

Both the horizontal and vertical rollers 222, 224 are received and kept in the guide channel, contacting the interior surfaces of the guide channel and movable along the guide channel. With these engagement, as the slidable hinge support bar 220 slides to the left or right, the horizontal and vertical rollers 222, 224 rotates within the guide channel of the roller guide bar 214 and facilitate the sliding operation of the slidable hinge support bar 220.

In other embodiments, one or more additional rollers can be provided to facilitate the slidable engagement between the roller guide bar 214 and the slidable hinge support bars 220. In other embodiments, the orientation of the rollers can differ from what is illustrated. Further, in other embodiments, the shape of the rollers and the interior surface of the guide channel can differ from what is illustrated. In other embodiments, the roller guide bar 214, despite its name, can be slidably engaged with the slidable hinge support bars 220 without a roller via other forms of slidable engagement, such as lubrication and using bearing. Further, in other embodiments, these other forms of slidable engagement can be used in addition to at least one of the horizontal and vertical rollers 222, 224.

Figure 4D:
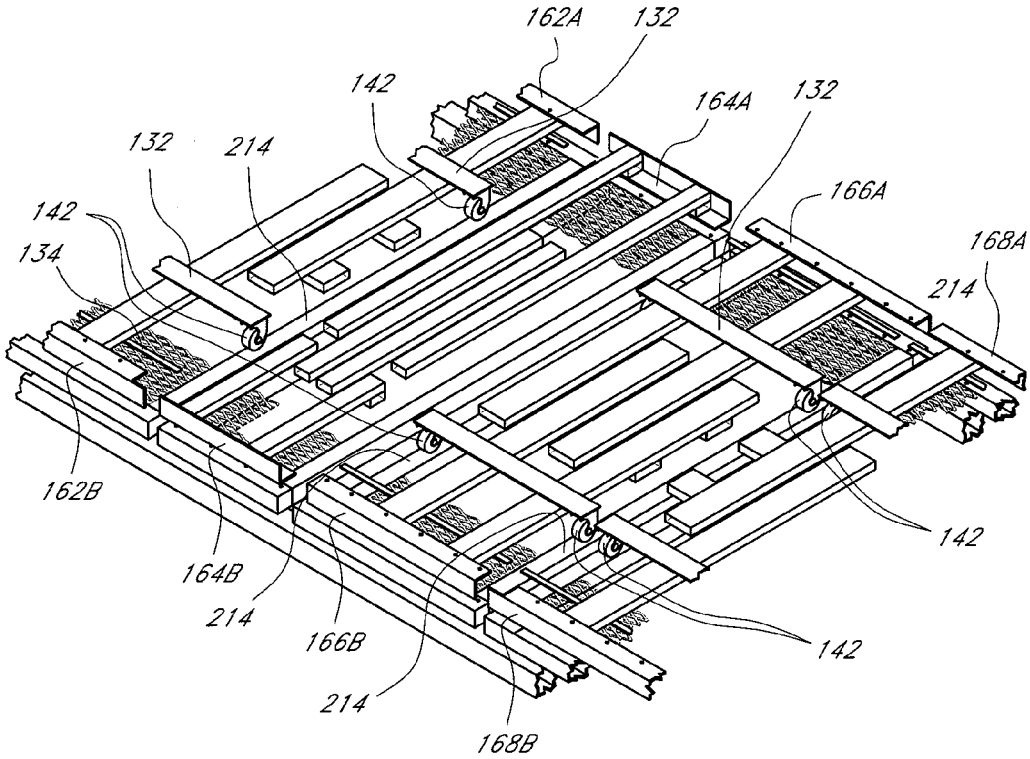
FIG. 4D illustrates sliding rollers between the top and intermediate frames.
Figure 4E:
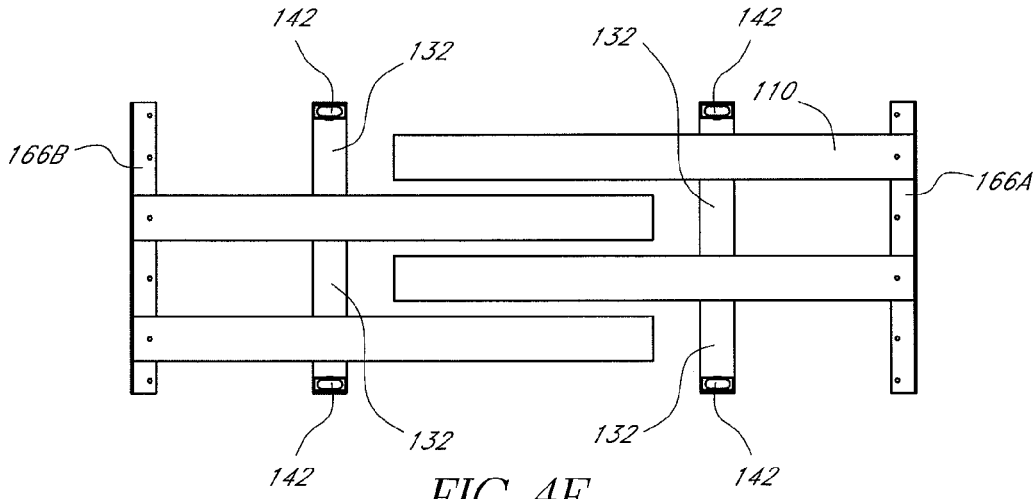
FIG. 4E is a bottom view of the top frame showing the sliding rollers in FIG. 4D.

FIGS. 4D and 4E provide an embodiment that can further facilitate the sliding between the top and intermediate frames 100, 200. In the illustrated embodiment, each strap 132 has rollers 142 on its surface facing the intermediate frame 200. The rollers 142 contact the top surface of the roller guide bars 214. These rollers 142 are arranged to roll along the top surface of the roller guide 214 as the top frame 100 slides relative to the intermediate frame 200 as will be discussed now. The rollers 142 are optional in various embodiments of the bed. Further, in other embodiments, additional rollers can be provided to facilitate the sliding between the top and intermediate frames 100, 200. Further, in other embodiments, additional or alternative means and tools can be provided for facilitating the sliding between the top and intermediate frames 100, 200.

Sliding of Top Frame

Figure 5:
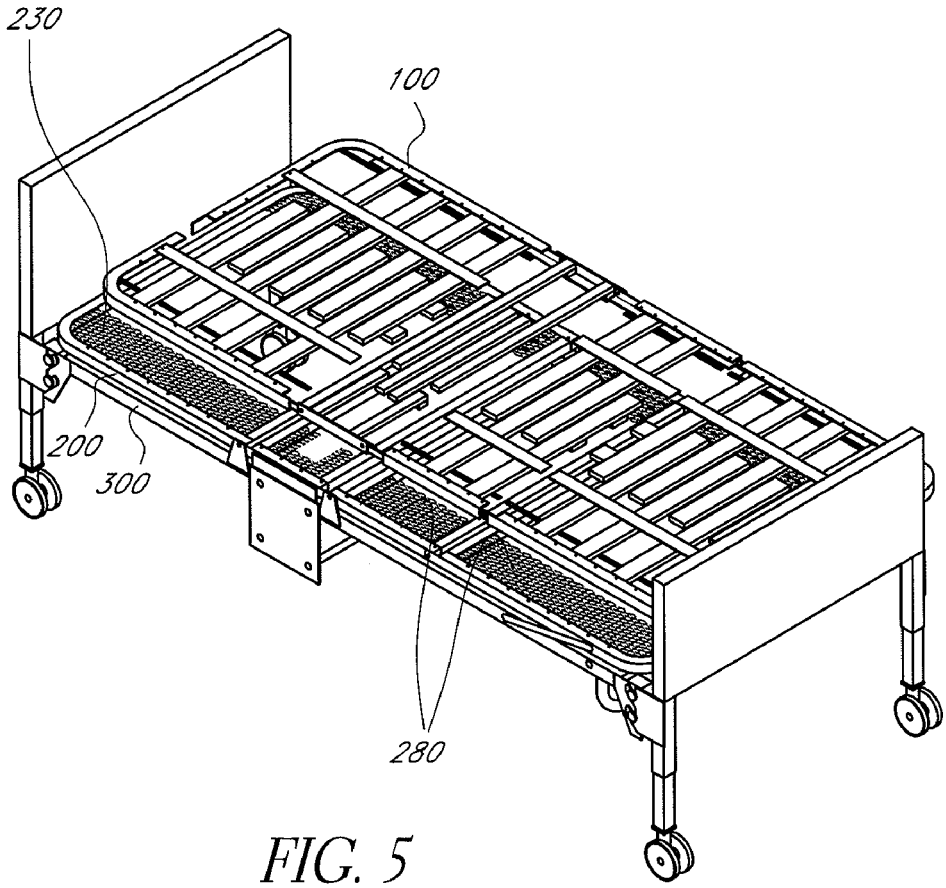
FIG. 5 illustrates a configuration of the bed, in which the top frame that has been slid to one side.

FIG. 5 illustrates a configuration of the bed 1000 according to an embodiment. In the illustrated configuration, the top frame 100 has been slid to the left side thereof (right side of the drawing sheet). The sliding of the top frame 100 exposes a portion 280 of the intermediate frame 200, which is under the top frame 100 when the top frame 100 is in its normal position as illustrated in FIG. 1. Optionally, the intermediate frame 200 has a mesh structure 230 in the exposed portion 280 in order to support a person's body or anything that can be placed on that portion at the time when the bed is in the configuration shown in FIG. 5. Although not illustrated, the top frame 100 is capable of sliding to the other side and expose another portion of the intermediate frame 200. Optionally, a mesh structure is formed in the other portion as well.

Lifting of Top Frame

FIG. 6 illustrates a configuration of the bed 1000 according to an embodiment. In the illustrated configuration, the top frame 100 has been slid to the left side thereof and further a left section 192A of the top frame 100 is raised. Here, the term "left section" 192A refers to collectively the left portions of the head section 162, hip section 164, upper leg section 166 and lower leg section 168. Although not illustrated, in case the top frame 100 has been slid to the right side of the bed 1000, the top frame 100 is capable of having the right section lifted. Here, the term "right section" 192B similarly refers to the right portions of the head section 162, hip section 164, upper leg section 166 and lower leg section 168.

Sliding and Lifting Mechanism

Figure 7A:
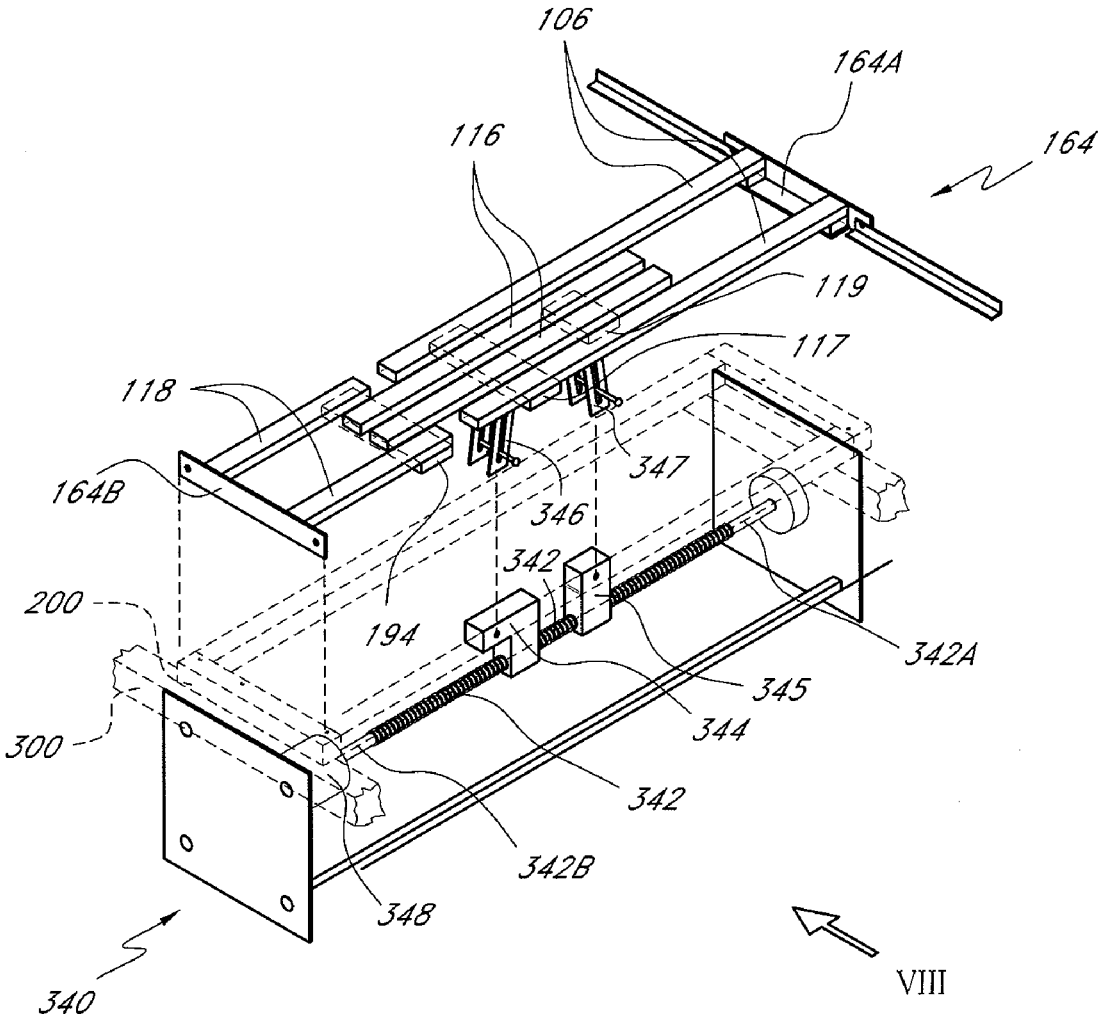
FIG. 7A illustrates a sliding and lifting mechanism of the bed.

FIG. 7A illustrates an embodiment of the sliding and lifting mechanism 340. In the illustrated embodiment, the sliding and lifting mechanism 340 includes a drive screw 342 and a motor 348 for rotating the drive screw 342. The drive screw 342 has a threaded portion and two non-threaded portions 342A, 342B at both sides of the threaded portion. Two traveler nuts 344, 345 are engaged with the threads of the drive screw 342 and capable of traveling along the drive screw 342 as the drive screw 342 rotates. In other embodiments, the drive screw 342 and traveler nuts 344, 345 can be replaced with functionally similar devices, in which two traveling pieces travel between the right and left sides of the bed.

In the illustrated embodiment, the traveler nut 344 is connected with a lifting arm 346, which is fixed to the mattress support bars 106 of the hip section 164. The two mattress support bars 106 are integrated together, for example, using a mechanical connector 117 connecting them from the underside thereof. In the embodiment, the lifting arm 346 is fixed to the mechanical connector 117 at about the mid-point between the two mattress support bars 106, although not limited thereto.

In the illustrated embodiment, the traveler nut 345 is connected to a lifting arm 347, which is fixed to the mattress support bars 116. In the embodiment, the mattress support bars 116 are integrated with the two mattress support bars 118, for example, via a mechanical connector 194 connecting them from the underside thereof. Further in the embodiment, the two mattress support bars 116 are integrated together, for example via a mechanical connector 119 connecting them from the underside thereof. In the embodiment, the lifting arm 347 is fixed to the mechanical connector 119 at about the mid-point between the two mattress support bars 116, although not limited thereto.

Figure 7B:
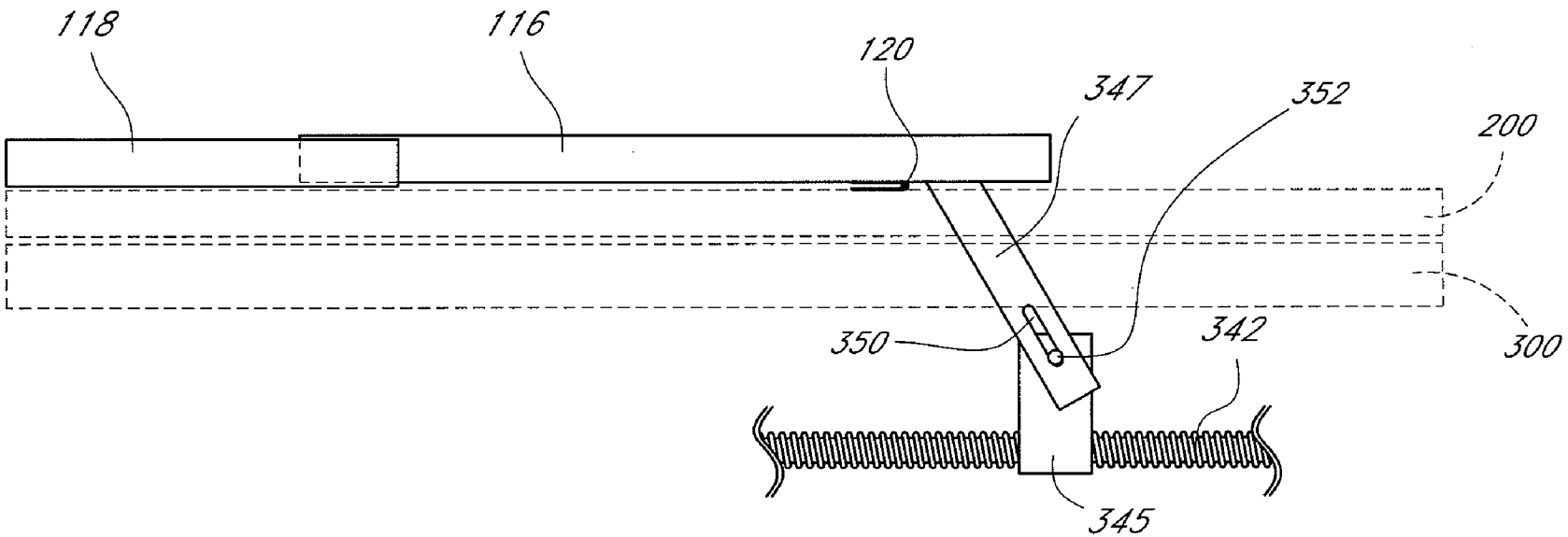
FIG. 7B illustrates a connection between the top frame and the sliding and lifting mechanism.

FIG. 7B is a view taken in the direction of VII in FIG. 7A and illustrates an embodiment of the connection between the lifting arm 347 and the traveler nut 345. The lifting arm 347 has a slit 350, in which the traveler nut 345 is engaged using a pin 352. FIG. 7B further shows the hinged connection between the mattress support bar 116 and the intermediate frame 200 (slidable hinge support bar 220, not shown) via the hinge 120. The slit 350 of the lifting arm 347 provides a guide channel through which the pin 352 moves along when the mattress support bar 116 rotates about the axis of the hinge 120, as will be discussed later. The traveler nut 344 and the lifting arm 346 are similarly connected.

Sliding Operation

Figure 8A:
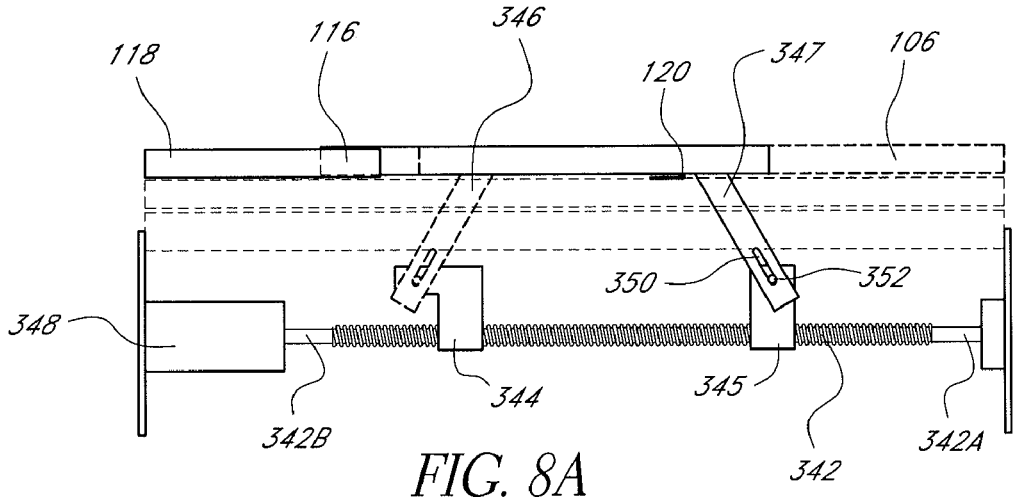
FIGS. 8A and 8B illustrate sliding operation with the sliding and lifting mechanism.
Figure 8B:
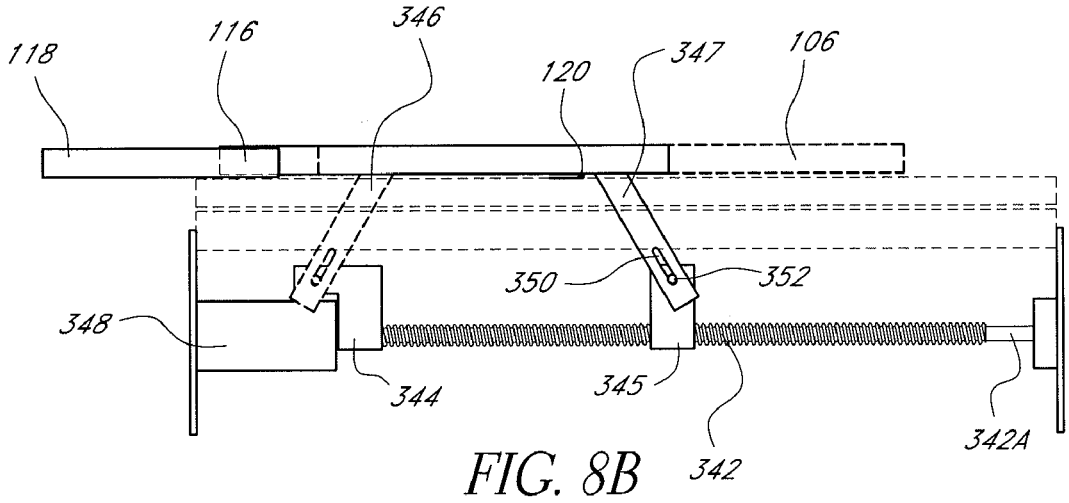

In embodiments, the sliding and lifting mechanism 340 actuates the sliding of the top frame 1000 relative to the remainder of the bed 1000. FIGS. 8A and 8B illustrate embodiments of sliding operation of the bed 1000, which provide relative positions of the traveler nuts 345, 346 and the corresponding positions of the top frame 100. In FIG. 8A, the top frame 100 is in its normal position, i.e. the top and intermediate frames 100, 200 are almost totally overlapping with each other. According to embodiments, as the drive screw 342 rotates in a first rotational direction, the traveler nuts 344, 345 travel along the drive screw 342 in a direction, e.g. to the left of the drawing sheet.

Referring to FIG. 8B, the traveler nuts 344, 345 have moved to the left of the drawing sheet. Accordingly, the lifting arms 346, 347 have moved to the left of the drawing sheet, and as a result, the top frame 100 has moved to the left of the drawing sheet too. In FIG. 8B, according to one embodiment, the traveler nut 344 has reached the non-threaded portion 342B (see FIG. 8A) of the drive screw 342, while the traveler nut 345 is still engaged with the threaded portion.

In embodiments, when the drive screw 342 rotates in the opposite (a second) rotational direction, the traveler nut 344 becomes engaged with the threaded portion of the drive screw 342 again. Then, both traveler nuts 344, 345 begin to travel along the drive screw 342 to the right side of the drawing sheet. Accordingly, the lifting arms 346, 347 and the top frame 100 move to the right side of the drawing toward its normal position. Further, in embodiments, as the drive screw 342 continues to rotate in the second rotational direction, the similar operation occurs to slide the top frame 100 to the right side of the drawing sheet.

According to embodiments, the movement of the lifting arms 346, 347 to one side pushes the mattress support bars 106, 116, 118 of the hip section 164, to which the lifting arms are attached. The mattress support bars 106, 116, 118 then push the left or right side rail 164A, 164B of the hip section 164, which causes the extensions 182A, 186A, 188A or the extensions 182B, 186B, 188B to push the side rails 162A, 166A, 168A or the side rails 162B, 166B, 168B to the same direction. Further, in the embodiments where the slidable hinge support bars 220 of the intermediate frame 200 are integrated together, the movement of the mattress support bars 106, 116, 118 also cause the slidable hinge support bars 220 to slide together to the direction. Since each slidable hinge support bar 220 is hingedly attached to a mattress support bar 110, sliding of the slidable hinge support bars 220 then causes the mattress support bars 110 to move. As a result, the top frame 100 slides to the same direction.

Lifting Operation

In embodiments, the sliding and lifting mechanism 340 further actuates the lifting of the left or right section 192A, 192B of the top frame 100 (FIG. 6). In the configuration of FIG. 8B, the traveler nut 344 has reached the non-threaded portion 342B of the drive screw 342 and further contacted the housing of the motor 348. Thus, the traveler nut 344 is not capable of traveling to the left side of the drawing sheet, and accordingly its connected components of the bed (including the top frame) cannot move to the left side of the drawing either. On the other hand, as the drive screw 342 continues to rotate in the first rotational direction from the arrangement of FIG. 8B, the traveler nut 345 continues to travel to the left side of the drawing sheet. However, since the top frame is not moving to the left side, the force from the traveling nut 345 begins to cause the mattress support bars 116, 118 and the lifting arm 347 to rotate about the axis of the hinge 120.

Figure 9A:
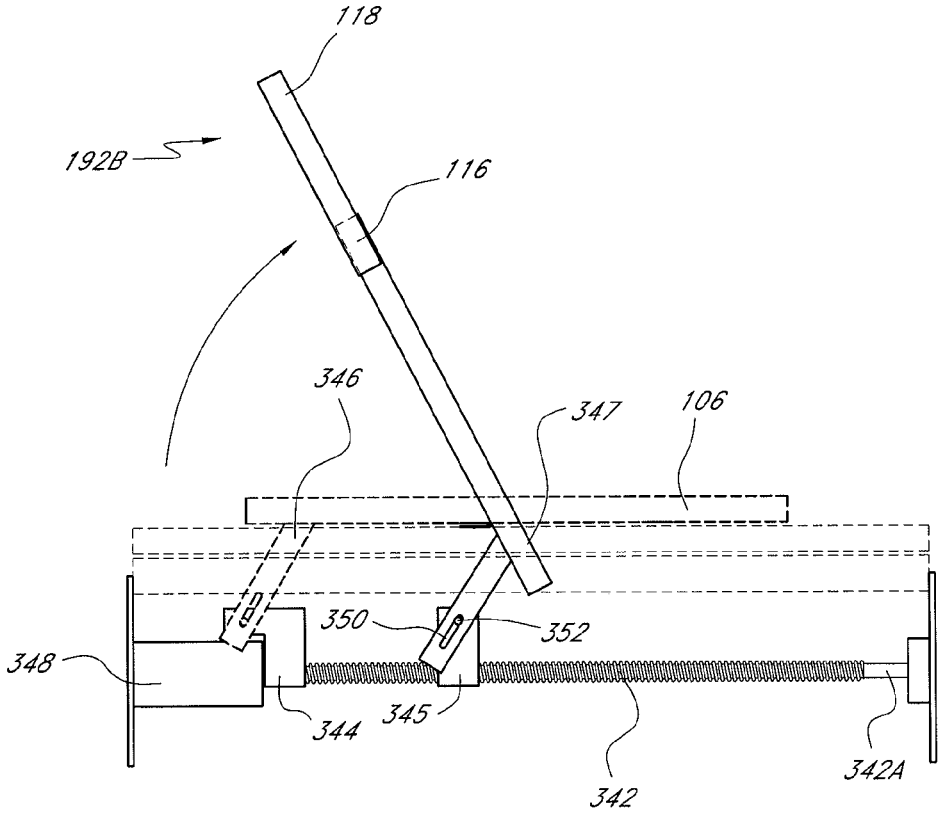
FIGS. 9A and 9B illustrate lifting of a left or right section of the top frame and the operation of the sliding and lifting mechanism for the lifting.
Figure 9B:
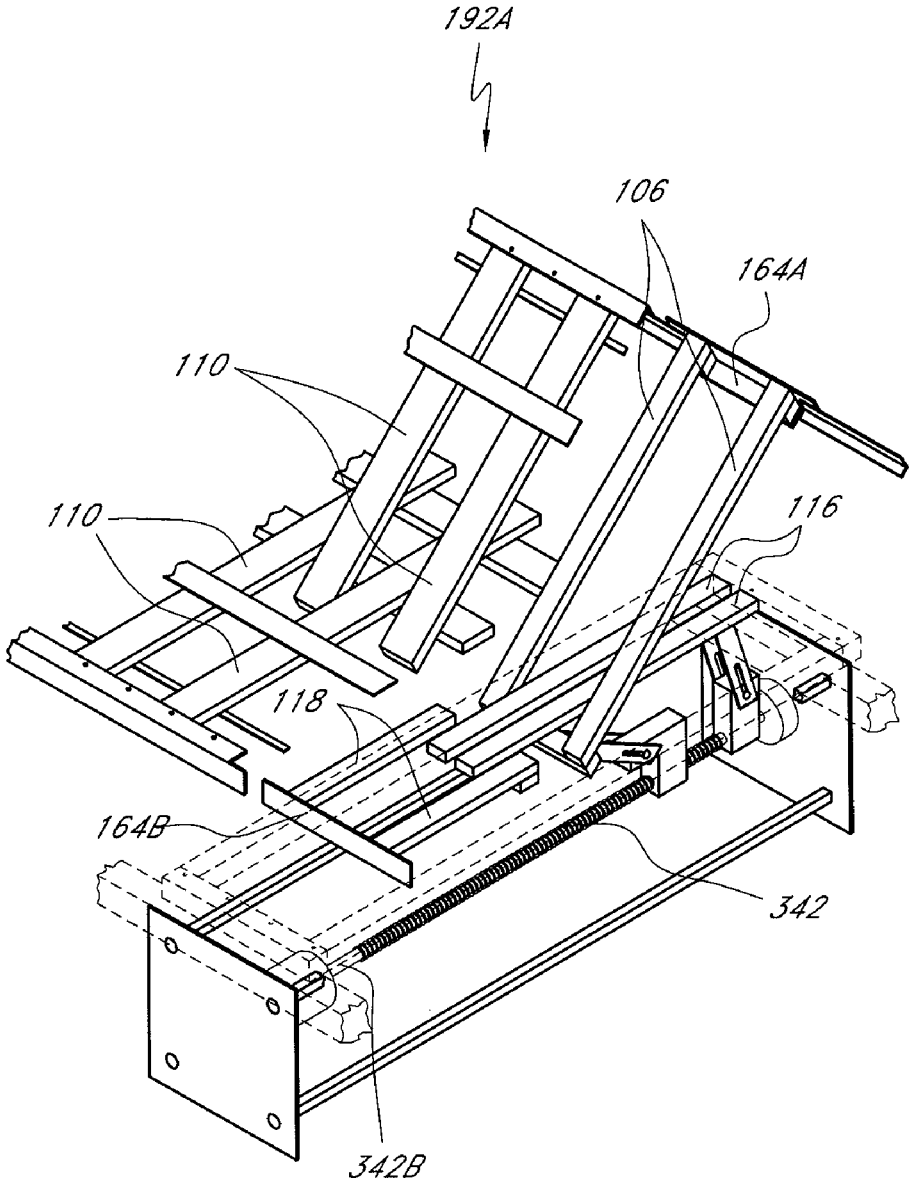
Figure 10A:
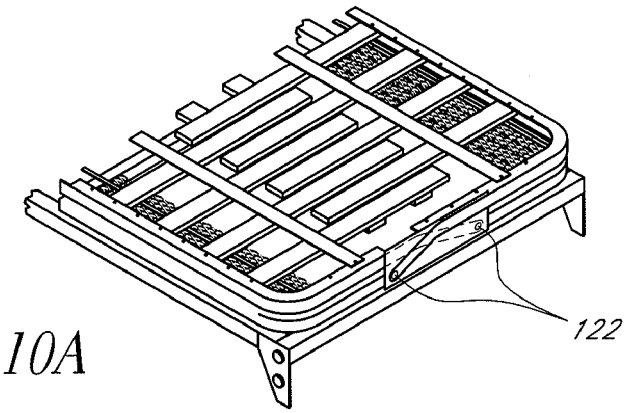
FIGS. 10A, 10B, and 10C illustrate sliding and lifting operations of the bed from another perspective.
Figure 10B:
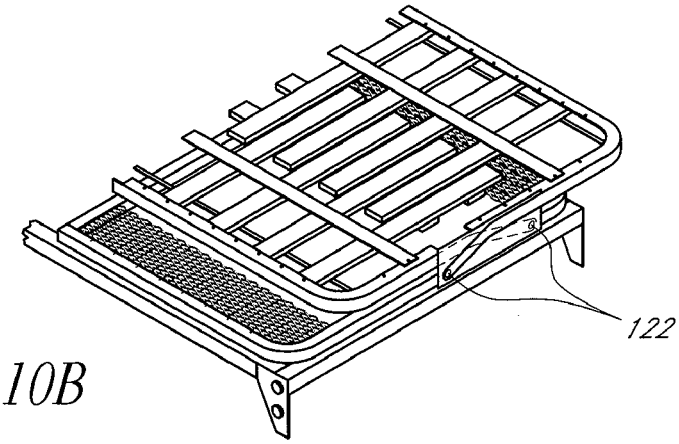
Figure 10C:
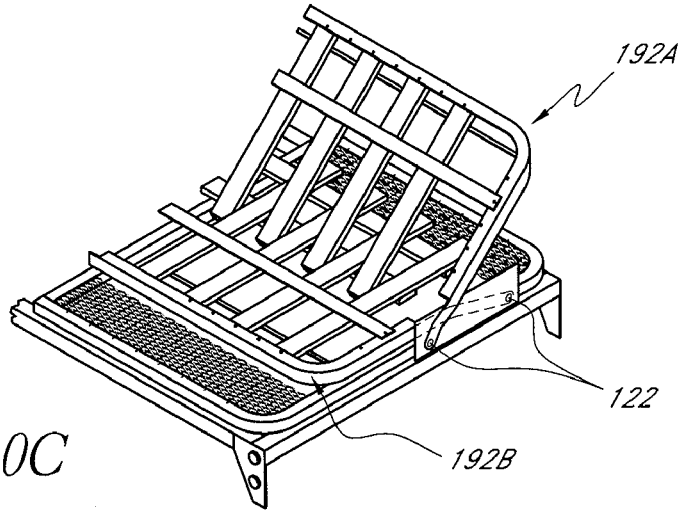

FIG. 9A illustrate an embodiment, in which the right section 192B (left in the drawing) of the top frame 100 is lifted by the rotational action of the mattress support bars 116, 118 and the lifting arm 347. During the rotation, the pin 352 engaged with the slit 350 of the lifting arm 347 slides within the slit 350. This is because the rotation is about the axis of the hinge 120 rather than about the axis of the pin 352. FIG. 9B is a partial perspective view of the bed 1000, in which the left section 192A (right in the drawing) of the top frame 100 has been lifted. FIGS. 10A, 10B, 10C provide other partial perspective views of the bed 100 with different configurations.

Expansion of Mattress Supporting Area

Figure 6A:
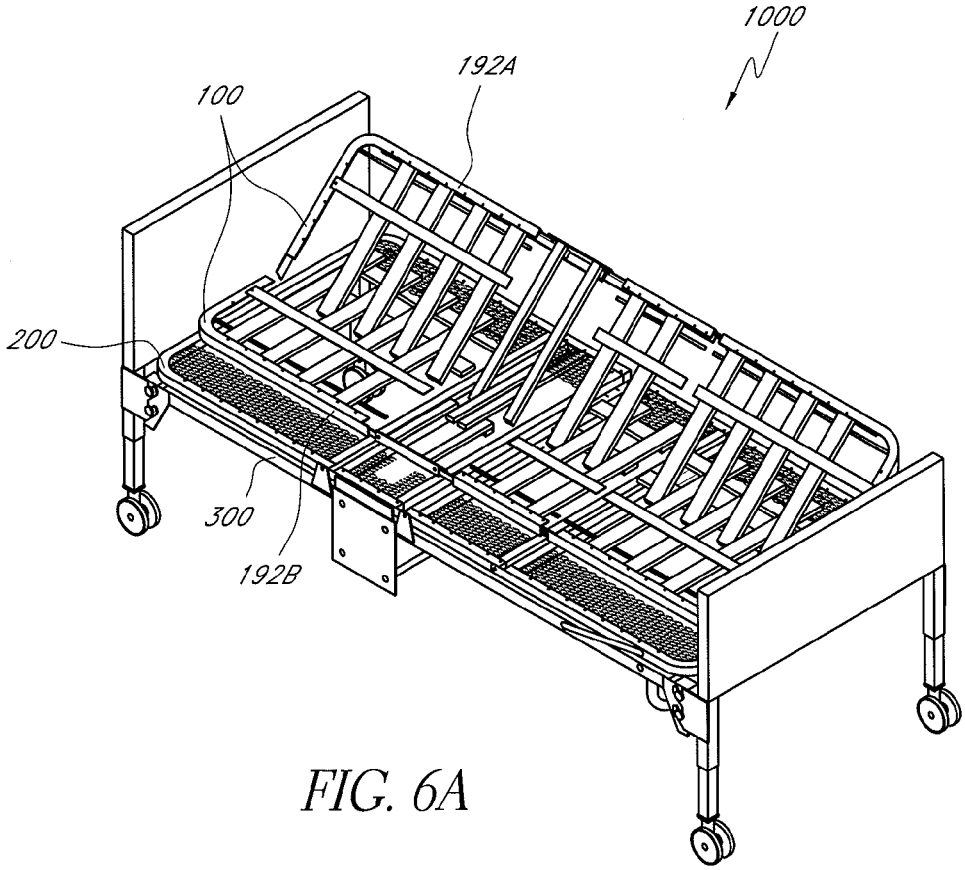
FIG. 6A illustrates a configuration of the bed, in which a left section of the top frame that has been lifted.
Figure 6B:
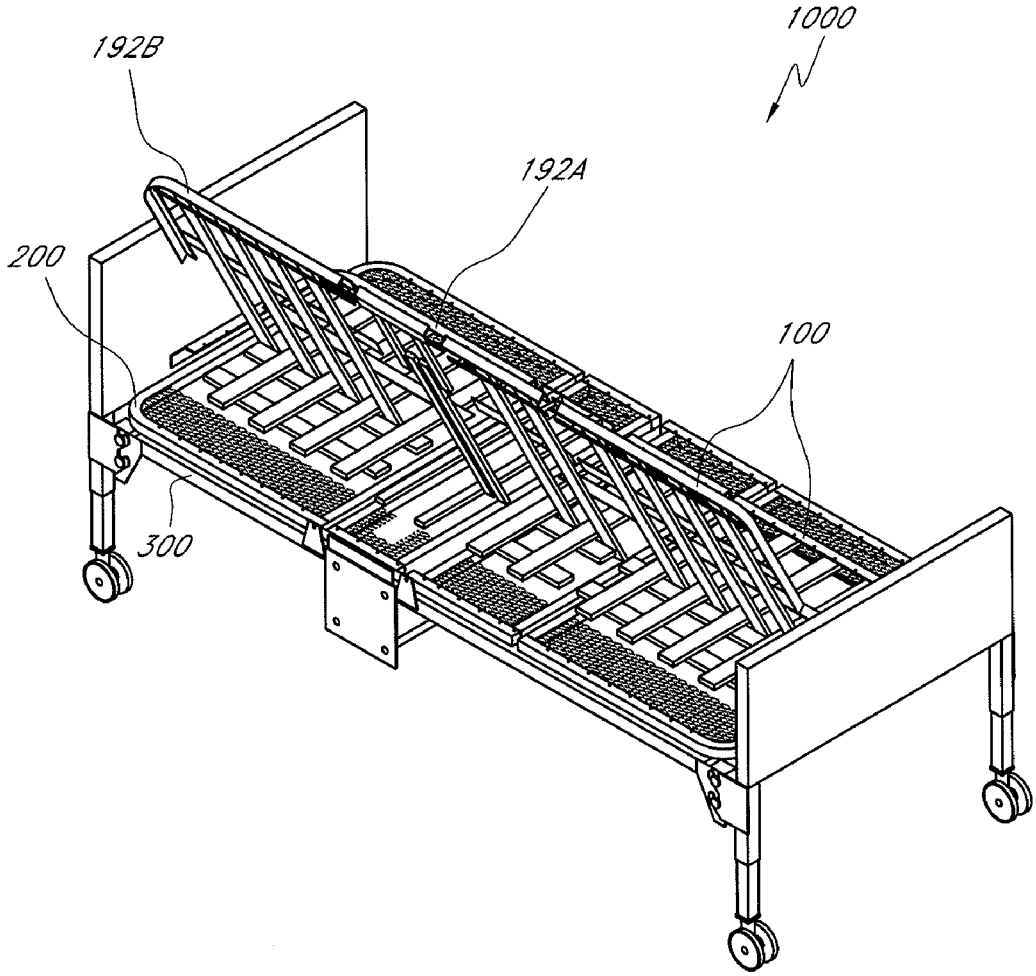
FIG. 6B illustrates a configuration of the bed, in which a right section of the top frame that has been lifted.

As discussed above, the sliding of the top frame 100 to one side opens the exposed portion 280 (FIG. 5) of the intermediate frame 200 and therefore expands the top surface or area of the bed 1000 on which a mattress or a person is to be supported. The additional top surface formed by the sliding helps the person stay on the bed 1000 during the lifting operation. This is because during the lifting of one section of the top frame 100, there is only one half or less than half the top surface remains flat to support the person (FIGS. 6A and 6B). Thus, the sliding feature is particularly helpful for the beds that are designed to be fitting in a space designed and/or assigned for a smaller sized bed, although not limited.

Certain embodiments of the invention provide the additional mattress support area using different sliding mechanisms. In one embodiment, although not illustrated, the left and right sections 192A, 192B of the top frame 100 are configured to slide relative to each other. For example, the left section 192A slides to the left side of the bed 1000 while the right section 192B remains still or slides the right side of the bed 1000. In either example, the left section 192A and the right section 192B are separated so as to expand the top surface of the bed 1000 that supports a person. In this embodiment, one of the two slidable hinge support bars 220 of the intermediate frame 200 is fixed to a mattress support bar(s) belonging to the left section 192A and the other slidable hinge support bar 220 is fixed to a mattress support bar(s) belonging to the right section 192B. In this embodiment, the engagement and connections of the sliding and lifting mechanism 340 with the mattress support bars 106, 116 need to be adjusted accordingly, which will be well appreciated by ordinary skills in the relevant technology.

Sitting Configuration of the Bed

Figure 11:
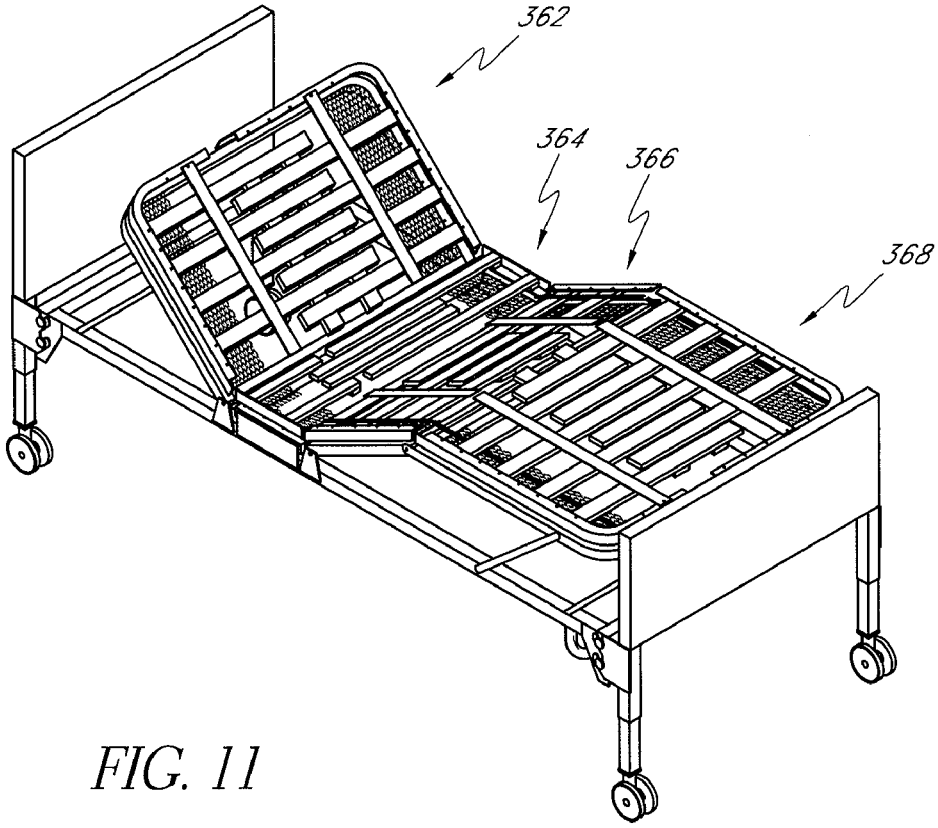
FIG. 11 illustrates a sitting configuration of the bed.

In embodiments, the bed 1000 is capable of forming a sitting configuration as illustrated in FIG. 11. In the illustrated configuration, the head section 362 and the upper leg section 366 have been hingedly lifted with reference to the base frame 300, while the hip section 364 remains as in FIG. 1. The lower leg section 368 has been overall lifted with reference to the base frame 300. In embodiments, the bending motions of the head section 362, upper leg section 366 and lower leg section 368 are actuated by one or more mechanisms including at least one of electric motors, levers, mechanical joints, shafts, hydraulic actuators. In embodiments, the head section 362, the upper leg section 366 and the lower leg section 368 are actuated by a separate mechanism. In other embodiments, two or more sections 362, 366, 368 are actuated by a single actuating mechanism.

Figure 12:
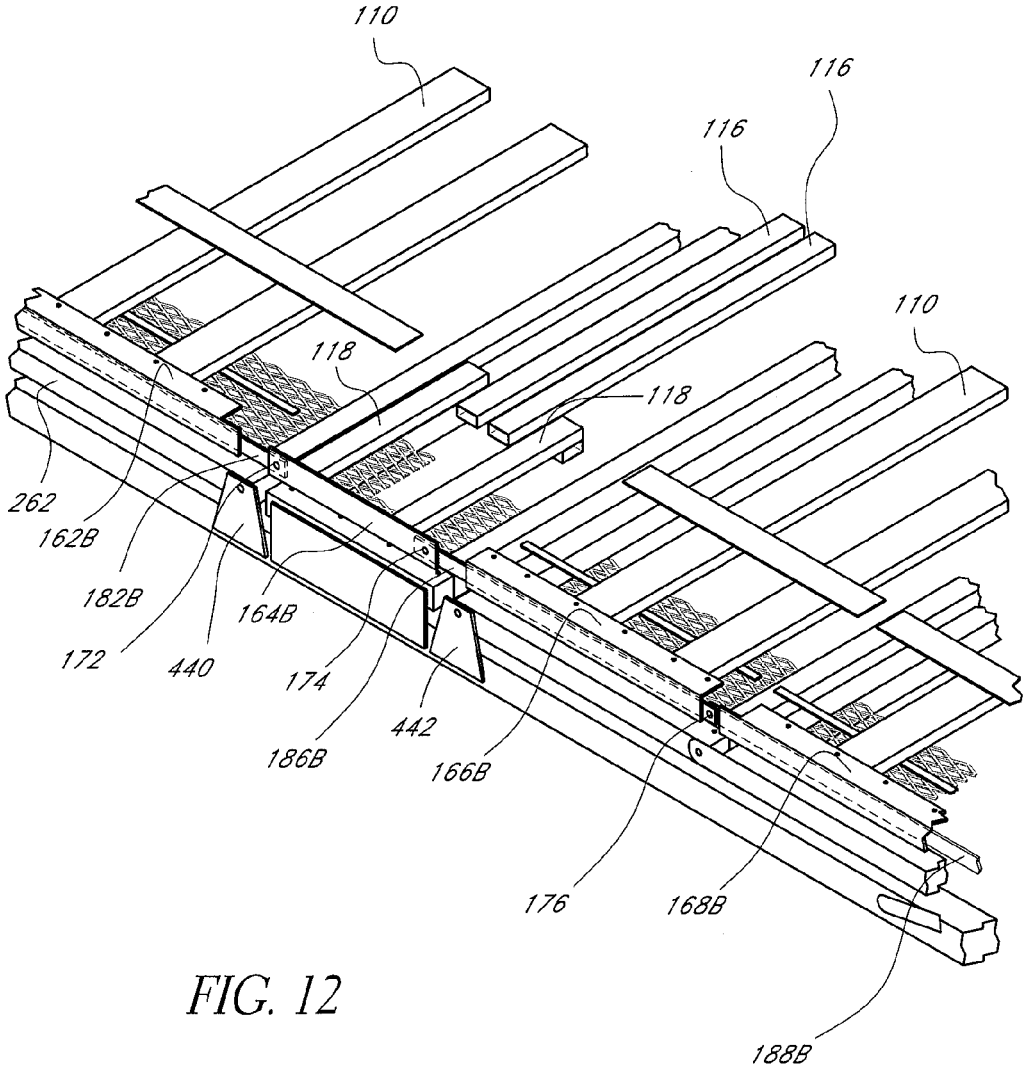
FIG. 12 illustrates hinged interconnections between the top, intermediate and base frames.

FIG. 12 illustrates an embodiment of joint connections between the top, intermediate and base frames 100, 200, 300. In the illustrated embodiment, the head section 262 of the intermediate frame 200 is hingedly connected to the base frame 300 via a hinge 440 near the hip section 264 of the intermediate frame 200. The head section 162 of the top frame 100 is also hingedly connected to the hip section 164 of the top frame 100 at the joint 172 between the extension 182B and the side rail 164B. Thus, the head section 362 (including 162 and 262) is capable of hingedly lifted about the axes of the hinge 440 and joint 172.

In the illustrated embodiment, the upper leg section 266 of the intermediate frame 200 is hingedly connected to the base frame 300 via a hinge 442 near the hip section 264 of the intermediate frame 200. The upper leg section 166 of the top frame 100 is also hingedly connected to the hip section 164 of the top frame 100 at the join 174 between the extension 186B and the side rail 164B. Thus, the upper leg section 366 (including 166 and 266) is capable of hingedly lifted about the axes of the hinge 440 and joint 174.

In the illustrated embodiment, the upper leg section 266 and the lower leg section 268 of the intermediate frame 200 are hingedly connected with each other. The upper leg section 266 and the lower leg section 268 of the intermediate frame 200 are hingedly connected with each other at the joint 444. The upper leg section 166 and the lower leg section 168 of the top frame 100 are hingedly connected with each other at the joint 176 between the extension 186B and the extension 188B. Thus, the upper leg section 366 (including 166 and 266) is capable of hingedly bending relative to the lower leg section 368.

Mattress

Figure 13:
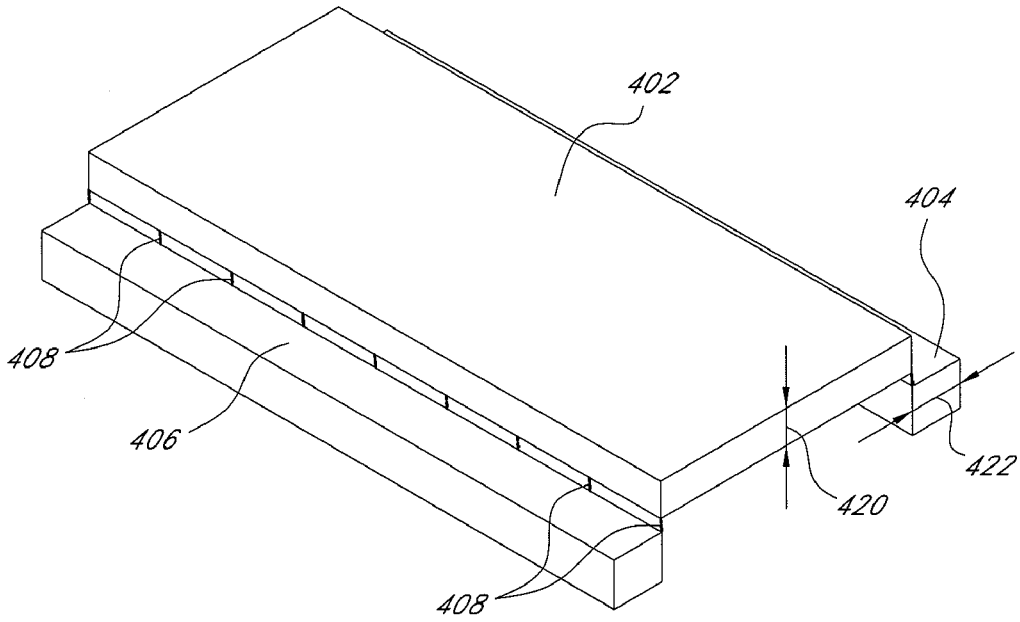
FIG. 13 illustrates a mattress assembly according to an embodiment of the invention.

FIG. 13 illustrates a mattress assembly 400 according to an embodiment, which is designed to use with the articulating bed 1000. The mattress assembly 400 includes a center mattress 402, a left side mattress piece 404, and a right side mattress piece 406. In the illustrated embodiment, the side mattress pieces are loosely connected to the center mattress 402 along its bottom edges by strings 408. In other embodiments, the side mattress pieces 404, 406 are connected to the center mattress 402 using other appropriate means such as straps, Velcro patches, etc. Also, in some embodiments, the side mattress pieces 404, 406 can be connected to different locations of the center mattress 402.

Figure 14A:
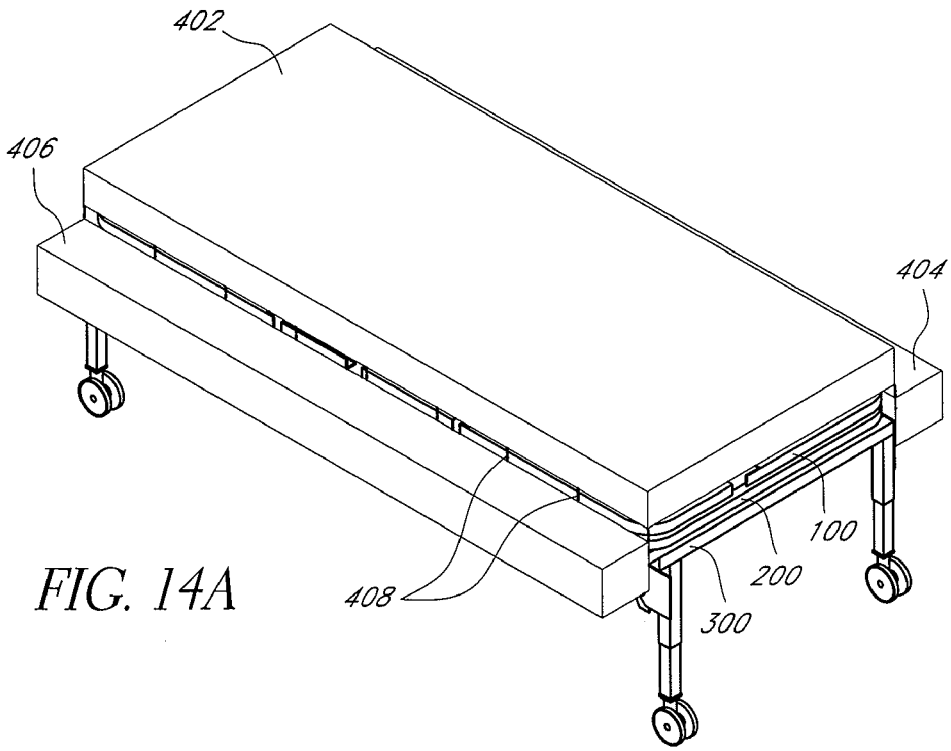
FIG. 14A illustrates a configuration of the mattress assembly placed over the bed, in which the top frame is in the center position.

FIG. 14A illustrate an embodiment, in which the mattress assembly 400 placed over the bed 1000. For the sake of illustration, the head and foot boards 316, 318 are not illustrated in this drawing. As shown, the center mattress 402 has about the same size as the top frame 100 in both width and length. In the illustrated embodiment, the top frame 100 is in its normal position, and the two side mattress pieces 404, 406 are hanging on the sides of the bed 1000.

Figure 14B:
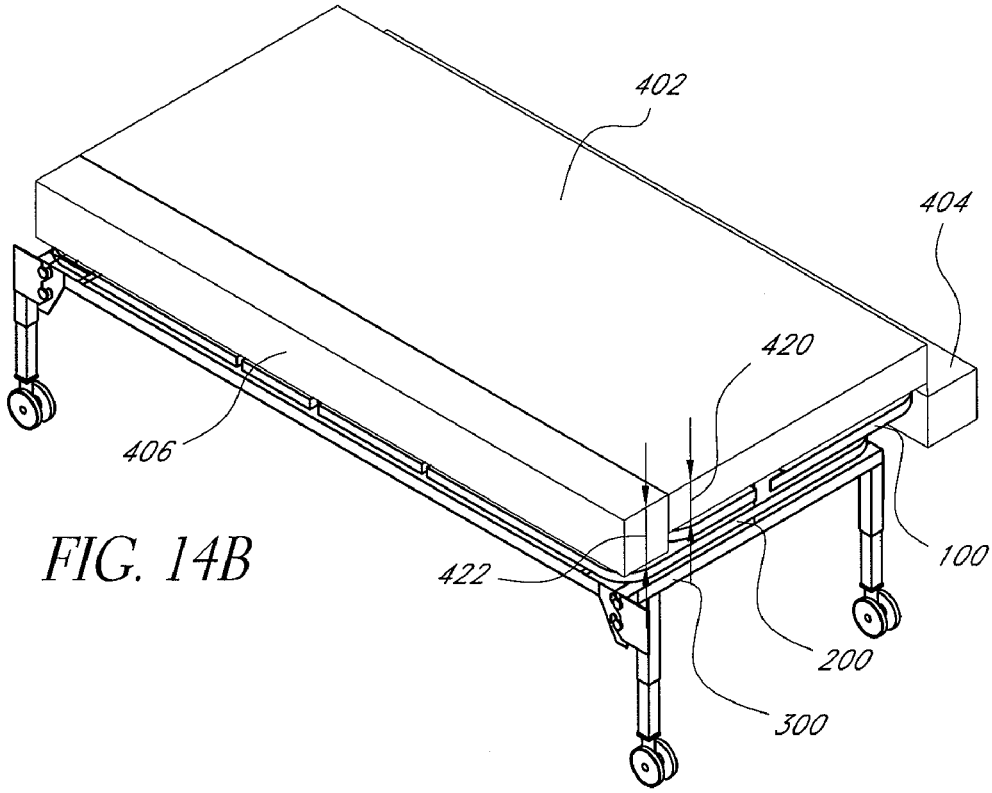
FIG. 14B illustrates a configuration of the mattress assembly placed over the bed, in which the top frame has been slid to one side.

FIG. 14B illustrates an embodiment, in which the top frame 100 has been slid to the left side of the bed 1000 as in FIG. 5. In the illustrated embodiment, the left side mattress piece 404 stays hanging on the left side of the bed 1000. On the other hand, the right side mattress piece 406 has occupied the space over the exposed portion 280 (see FIG. 5) of the intermediate frame 200. Therefore, the lying area of the bed 1000 on which a person can lie has been expanded by the width of the side mattress piece 404 or the exposed portion 280.

In an embodiment, the thickness 422 of the side mattress pieces 404, 406 are larger than the thickness 420 of the center mattress 402 approximately by the thickness of the top frame 100. In this embodiment, since the right side mattress piece 406 is now placed over the exposed portion 280 of the intermediate frame 200, the top surfaces of the center mattress 402 and the right side mattress piece 406 are at about the same level and there is not a large step therebetween.

Figure 14C:
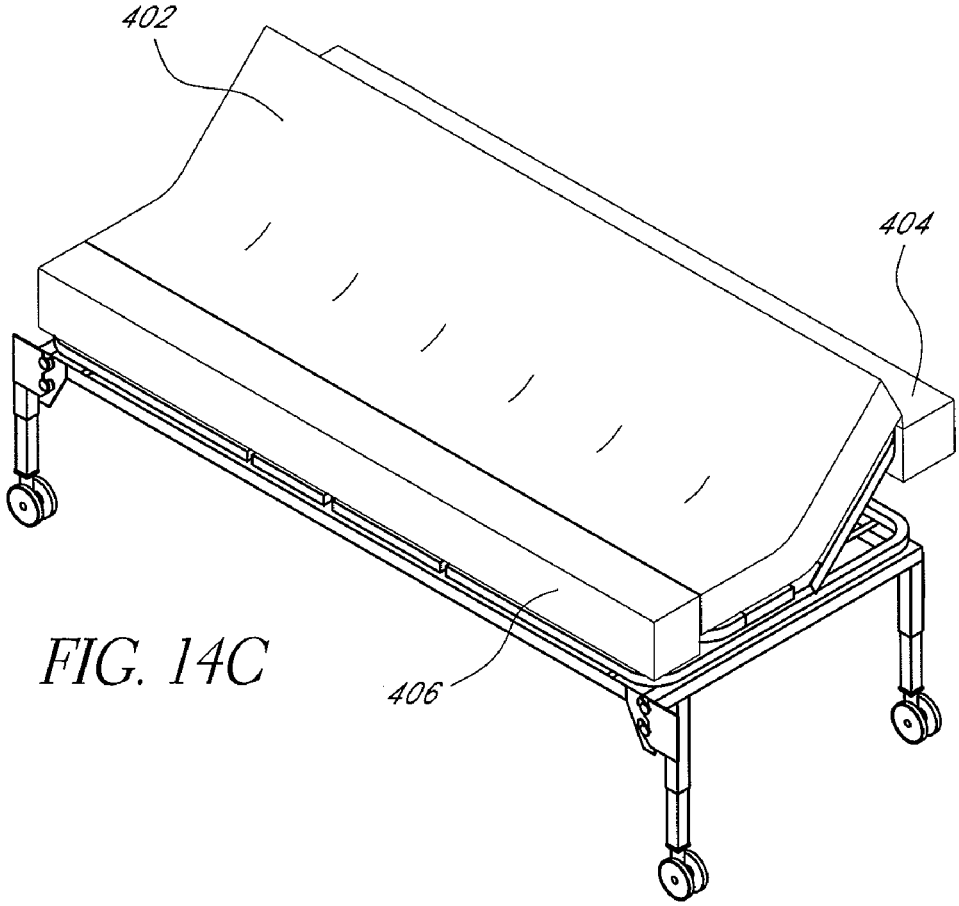
FIG. 14C illustrates a configuration of the mattress assembly placed over the bed, in which the left section of the top frame has been lifted.

FIG. 14C illustrates an embodiment, in which the left section 192A of the top frame has been lifted as in FIG. 6. In this configuration, the center mattress 402 is bent along the longitudinal direction of the bed. The remaining features are identical to FIG. 14B.

Head Rest

Figure 15A:
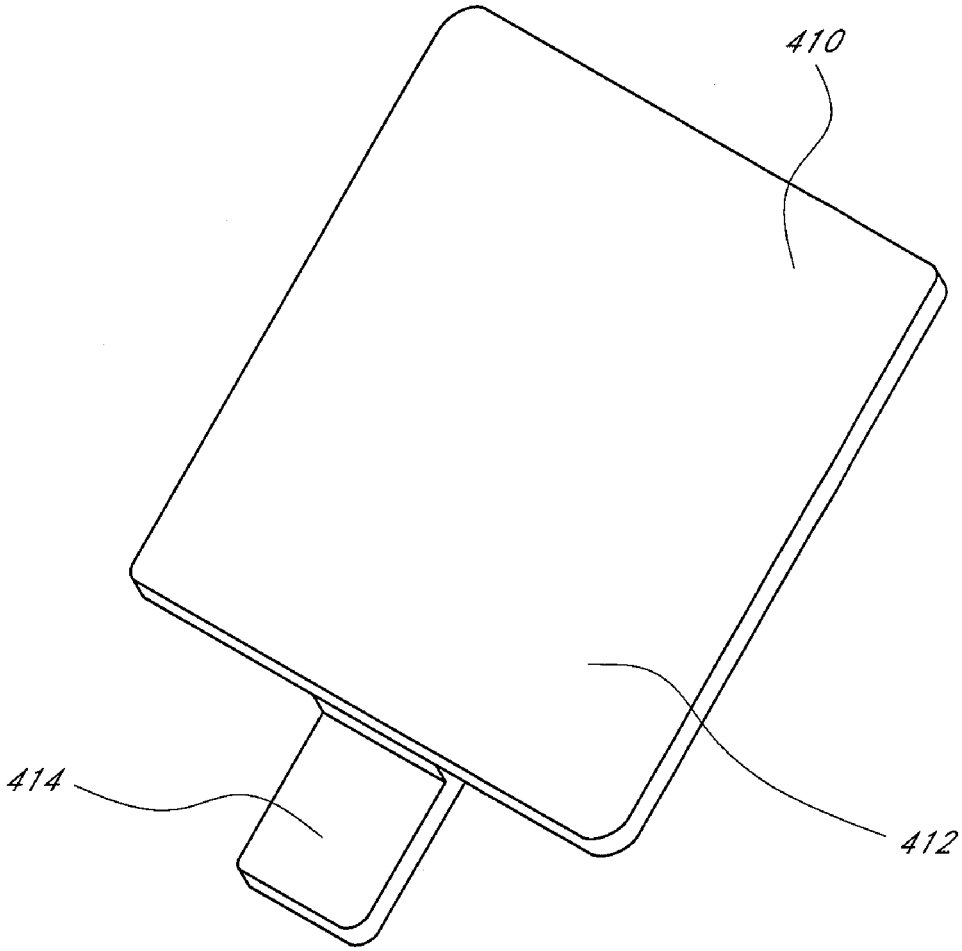
FIGS. 15A and 15B illustrate a head rest according to an embodiment.
Figure 15B:
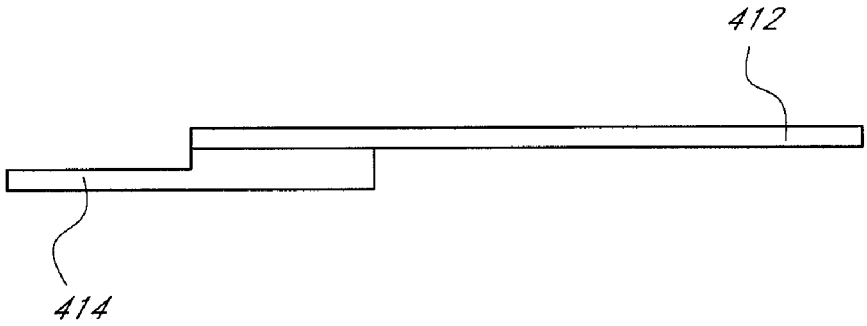
Figure 16A:
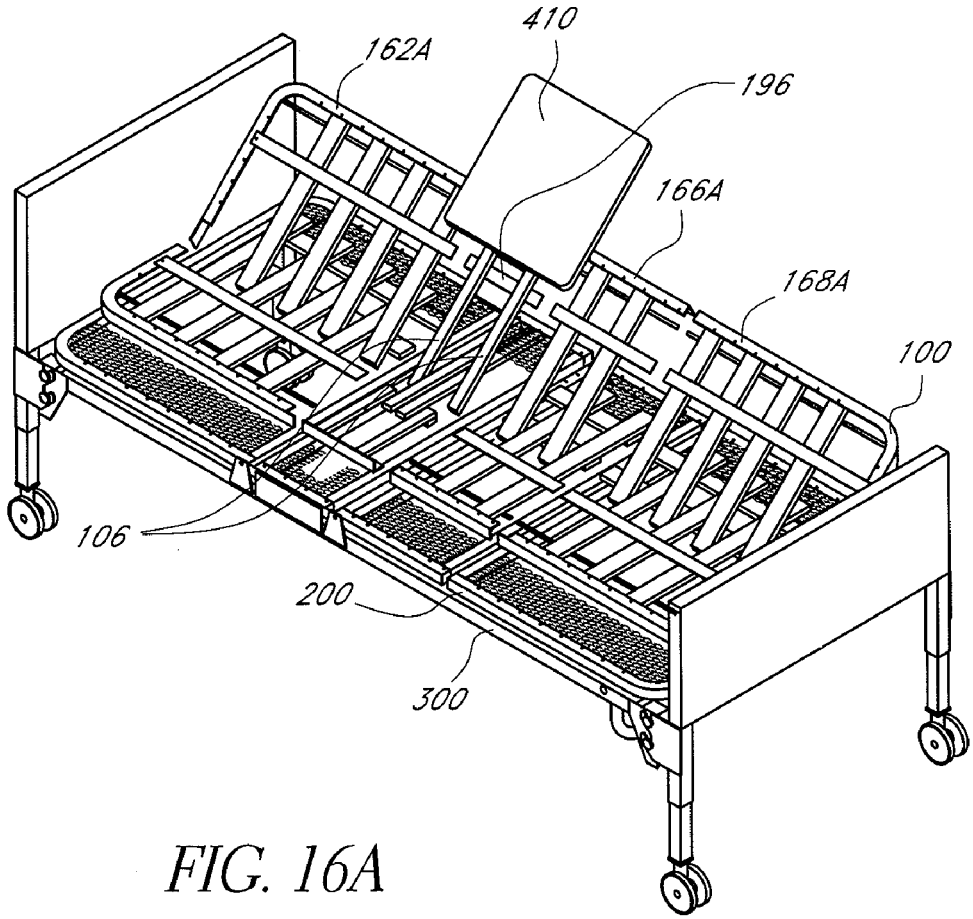
FIGS. 16A and 16B illustrate the engagement of the head rest with the bed.
Figure 16B:
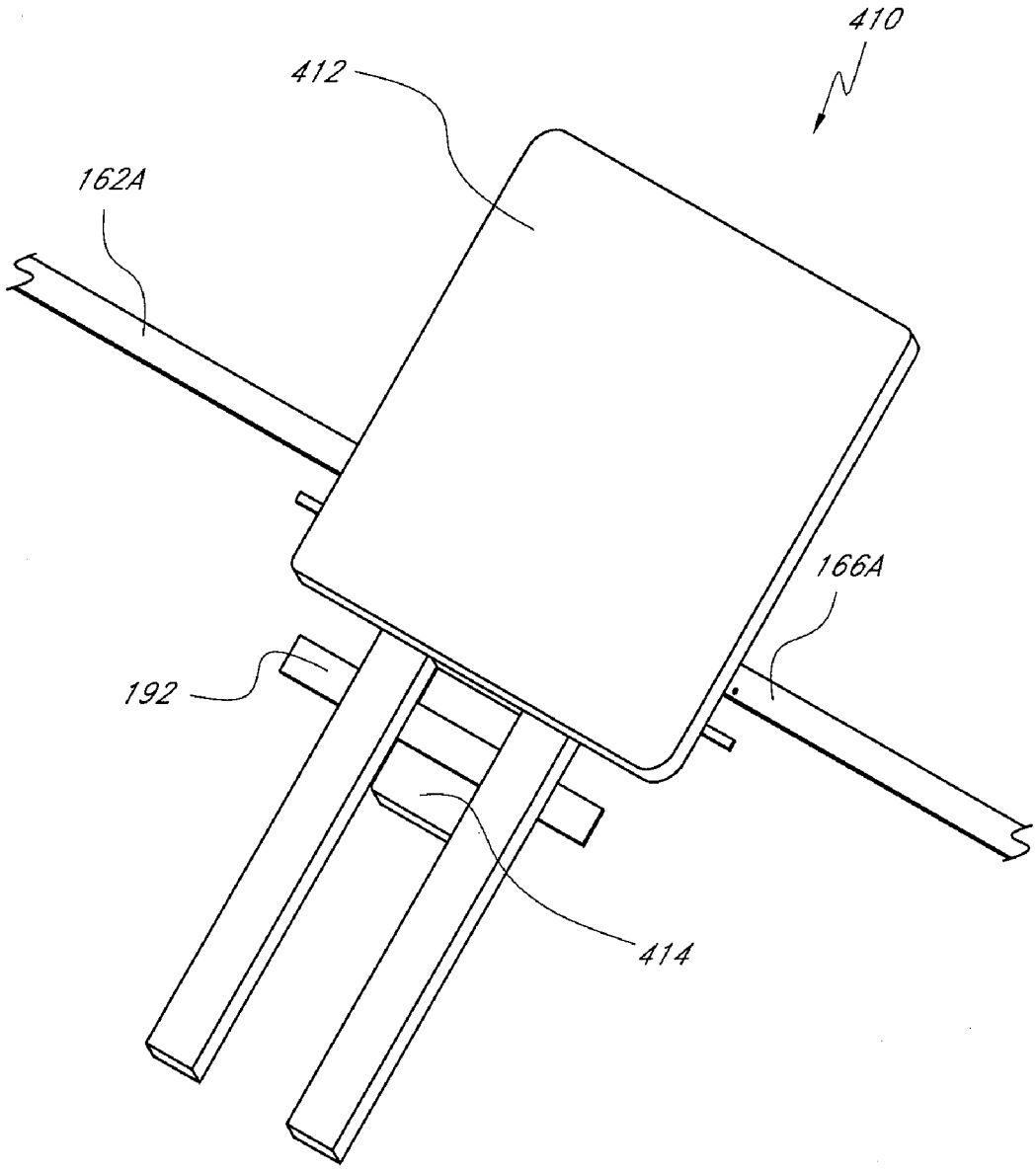

FIGS. 15A and 15B illustrate a head rest 410 according to an embodiment, which is designed to be used with the articulating bed 1000. In the illustrated embodiment, the head rest 410 includes a head supporting plate 412 and a connector 414 attached to the head supporting plate 412. Referring to FIGS. 16A and 16B, the connector 414 is engaged with a slot formed between the mattress support bars 106 and between the left side rail 164A (not shown) and a strap 196, which connects the mattress support bars 106 from the underside thereof.

Sitting-Up-To-Side Operation

Figure 17A:
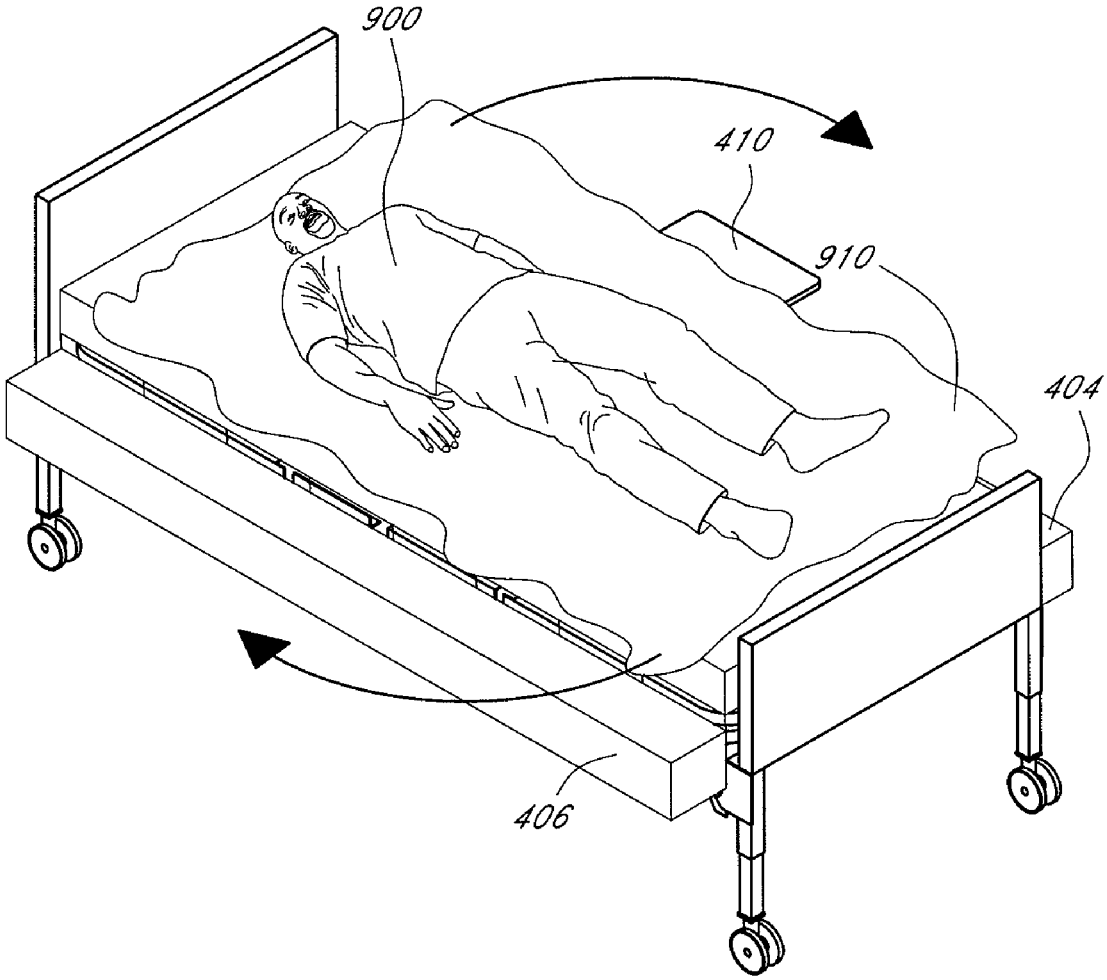
FIGS. 17A and 17B illustrate operation for sitting up a person lying on the bed to face to the side.
Figure 17B:
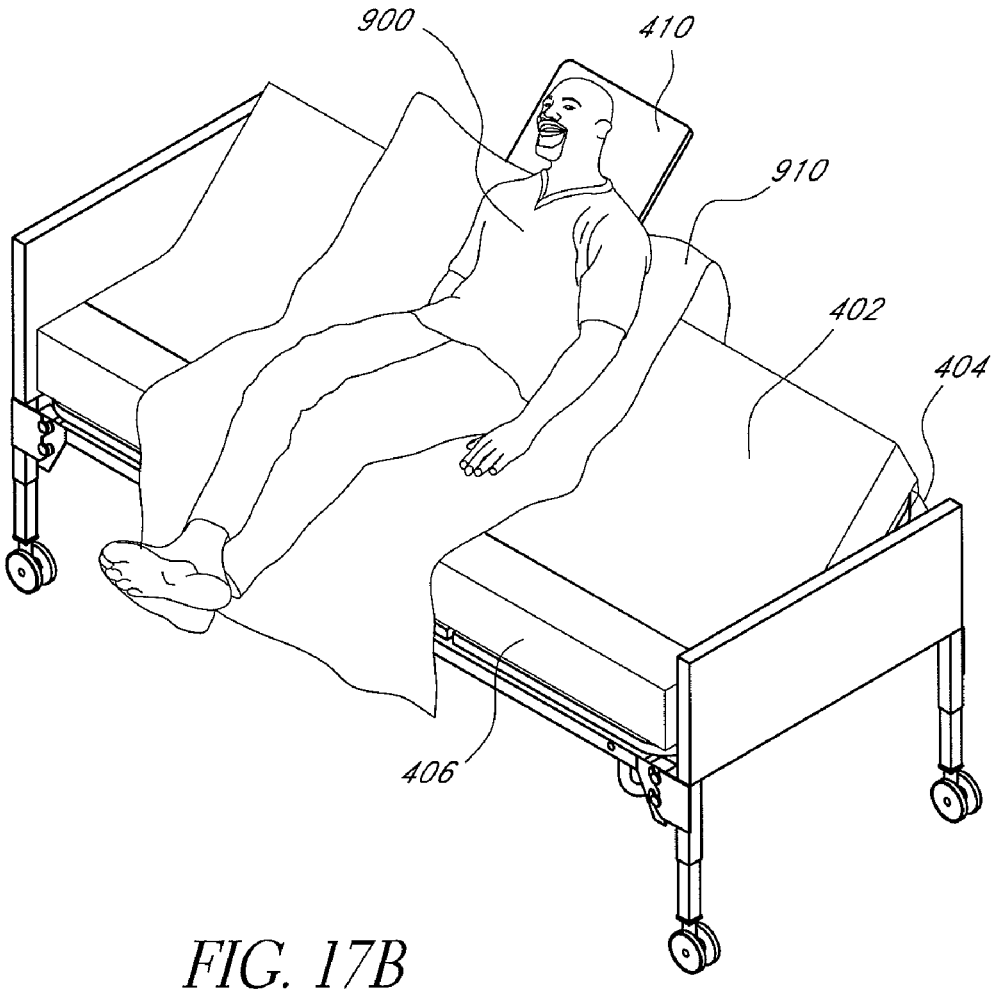
Figure 18:
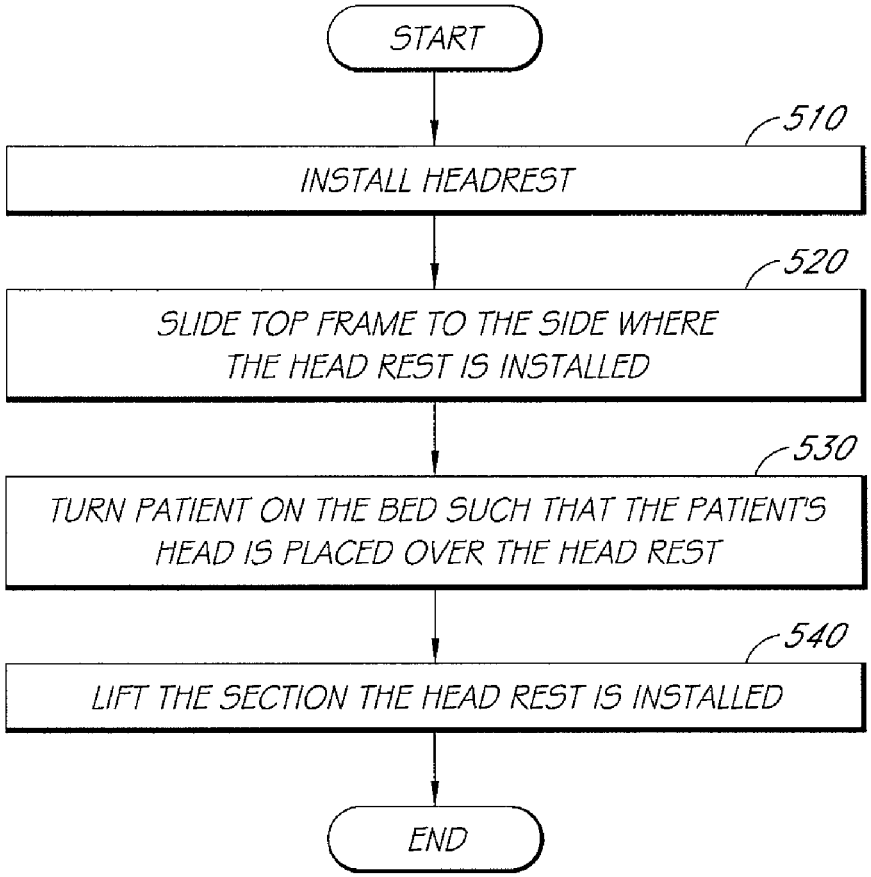
FIG. 18 is a flowchart for the sitting-up-to-side operation illustrated in FIGS. 17A and 17B.

Using the articulating bed 1000 and optionally using the head rest 410, a person lying on the bed can sit up with the legs hanging on one side of the bed 1000 as illustrated in FIGS. 17A and 17B. FIG. 18 is a flowchart for the sitting-up-to-side operation according to one embodiment. First at the step 510, the head rest 410 is installed on one side of the bed 1000, which is optional. Then, at the step 520, the top frame 100 is slid to the side where the head rest 410 is installed. This is to expand the lying area of the bed 1000 by the width of the side mattress piece 404, 406. Proceeding to the step 530, a liner 910 under the person 900 is turned so as to turn that person along (FIG. 17A) until the person's head is supported by the head rest 410. Next at the step 540, the left section 192 (FIG. 6) of the top frame 100 is lifted to sit the person 900 up (FIG. 17B) with the back and head supported and the legs hanging on the side of the bed. Following the foregoing operation, the person 900 can move to another bed or to a wheel chair alone or with a help.

The foregoing operation and its variations can be particularly useful to assist a person having a mobility difficulty to leave or get on the bed 1000. The same operation can be performed in the reverse order to have the person 900 lye on the bed 1000.

Liner Changing Operation

Figure 19A:
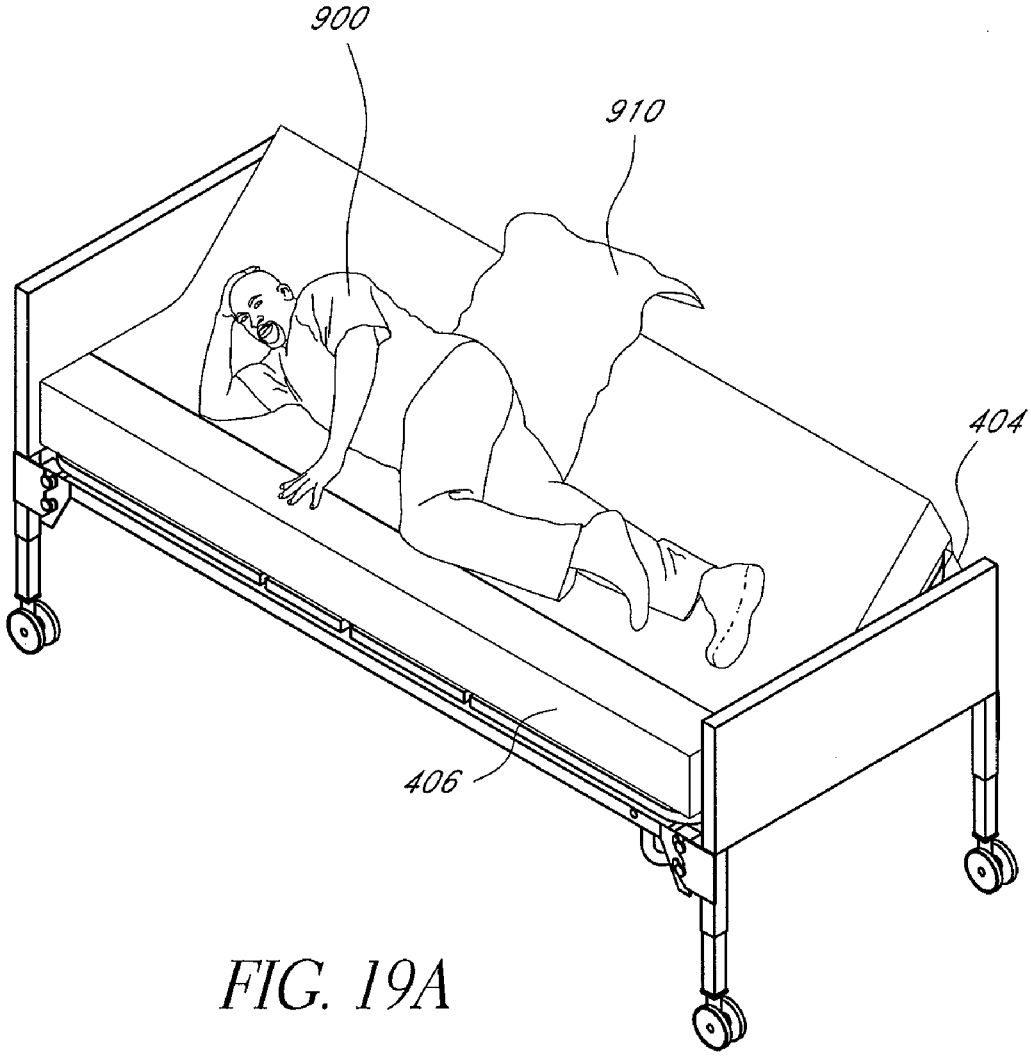
FIGS. 19A and 19B illustrate the operation for changing a liner of the bed while a person is lying on the bed.
Figure 19B:
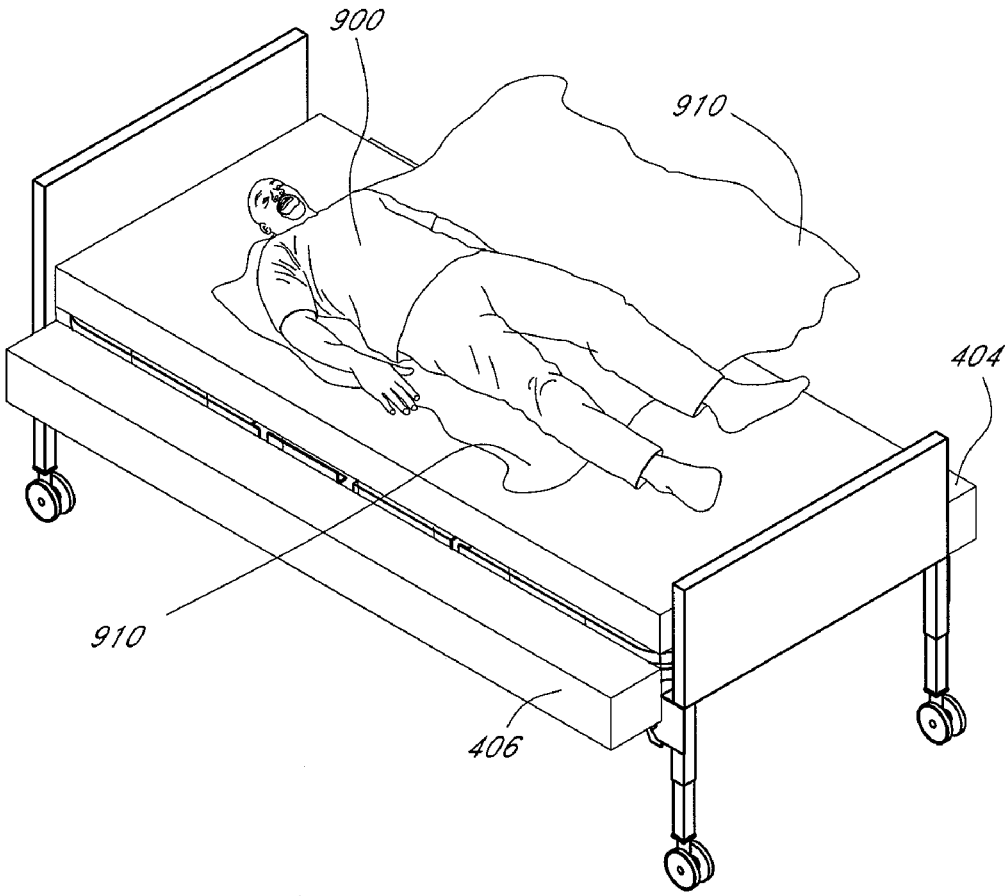
Figure 20:
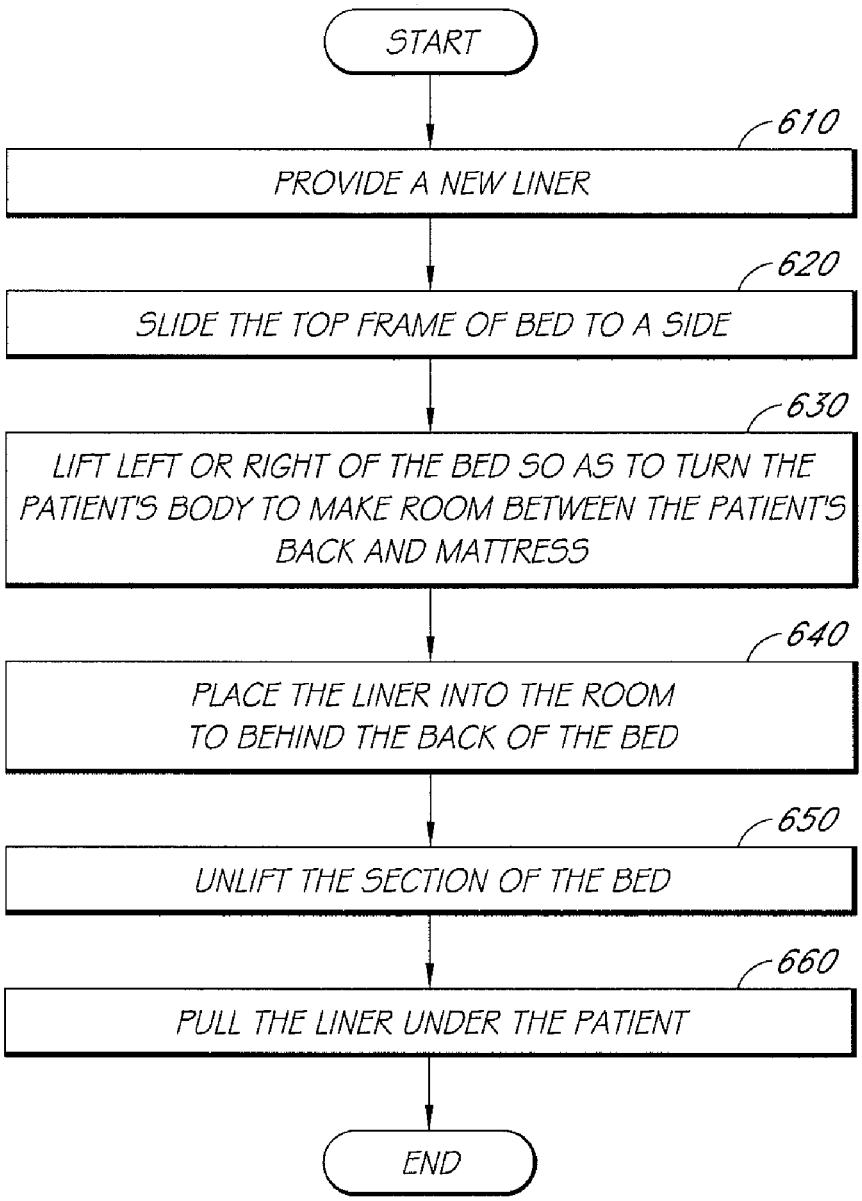
FIG. 20 is a flowchart for the liner-changing operation.

In addition, the articulating bed 1000 can be used to change liners without having to remove the person 900 from the bed 1000, as illustrated in FIGS. 19A and 19B. FIG. 20 is a flowchart explaining placing a liner under the person's body 900. First at the step 610 a new liner is provided for placing under the person's body 900. Next, at the step 620, the top frame 100 is slid to the left side (or right side) of the bed 1000. Then, at the step 630, the left section 192A (FIG. 6) of the top frame 100 is lifted (FIG. 19A). The lifting of the left section 192A typically causes the person's body 900 to slightly turn to the right side of the bed 1000, which creates a space between the person's back and the center mattress 402. If a space is not created spontaneously, the attendant may turn the person's body 900 slightly to create a space between the person's back and the center mattress 402.

Afterward, at the step 640, the attendant place or pushes the new liner into the space such that a portion of the liner can reach the bottom of the space. Then, at the step 650, the left section 192A is lowered to make the lying area flat. In this configuration, the portion of the liner reaching the bottom of the space can be reachable from the other side of the person's body 900. At the step 660, the attendant pulls the portion of the liner and stretch the liner. In the alternative or in addition, the top frame 100 may be slid to the right side of the bed 1000 (left in the drawing sheet) and the right section 192B of the top frame is lifted, which can facilitate to reach the portion of the liner and facilitate pulling and stretching the liner.

Removing an existing liner under the person's body 900 uses a similar operation, in which placing a new liner into the space is replaced with pushing the existing liner to the bottom of the space, so that the pushed liner could be pulled from the other side when the top frame is unlifted.

What is claimed is:

1. A bed comprising:

a first frame comprising a first side section and a second side section, wherein the first and second side sections are formed at about the same level so as to in combination substantially evenly support a mattress thereupon;

a second frame supporting the first frame; and wherein the first side section is configured to slide in a lateral direction of the bed relative to the second frame so as to vary a width of the bed, wherein the first side section is further configured to hingedly rotate about a hinge axis extending in a longitudinal direction of the bed only when a substantial portion of the first side section is slid outwardly in the lateral direction relative to the second frame.

2. The bed of claim 1, wherein the first side section and the second side section are coupled together and configured to slide together.

3. The bed of claim 2, wherein in a first configuration of the bed, the first frame substantially eclipses the second frame when viewed from the top, and the bed has a first width, and wherein in a second configuration of the bed, a substantial portion of the second frame is exposed when viewed from the top, and the bed has a second width, which is larger than the first width.

4. The bed of claim 3, further comprises:

a center mattress comprising a first side edge and a second side edge, wherein in the first configuration, the center mattress is placed over the first frame substantially eclipsing the second frame when viewed from the top; and a first side mattress depending from the center mattress along the first side edge of the center mattress, wherein in the first configuration, the first side mattress is not supported by either the first frame or the second frame, in the second configuration, the first side mattress is supported by the second frame.

5. The bed of claim 1, wherein the second side section is configured to remain still or slide in the lateral direction independent of the first side section.

6. The bed of claim 5, wherein the first and second side sections are configured to slide relative to each other between a first relative position and a second relative position, wherein in the first relative position, the first and second side sections are located the closest with each other, wherein in the second relative position the first and second side sections are the most remotely located from each other, and wherein in the second relative position a mattress support area is larger than in the first relative position.

7. The bed of claim 1, wherein the second frame comprises a slider and a sliding guide, wherein the slider is slidably engaged with the sliding guide and configured to slide generally in the lateral direction, wherein the slider is attached to the first side section such that sliding of the first side section is guided by the sliding guide of the second frame.

8. The bed of claim 7, further comprising a hinge having the hinge axis and hingedly interconnecting the first side section and the slider.

9. The bed of claim 1, further comprising a sliding mechanism configured to power sliding of the first section.

10. The bed of claim 1, wherein the first side section comprises a first side rail generally extending in a longitudinal direction of the bed, wherein the first side section is configured to hingedly rotate about the hinge axis generally parallel to the longitudinal direction such that the first side rail is lifted.

11. The bed of claim 1, further comprising a hinge hingedly connecting between the first side section and the second frame, wherein the first side section is configured to hingedly rotate via the hinge.

12. The bed of claim 1, further comprising a lifting mechanism configured to power hinged rotation of the first section.

13. The bed of claim 1, further comprising an actuating device configured to power both sliding and hinged rotation of the first section.

14. The bed of claim 13, wherein the actuating device comprises a driving rod, a first traveling nut and a second traveling nut, wherein the driving rod extends generally in the lateral direction and configured to rotate, wherein the first and second traveling nuts are engaged with the driving rod and configured to travel along the driving rod as the driving rod rotates.

15. The bed of claim 14, wherein the first traveling nut is connected to the first side section and configured to power sliding of the first side section in the lateral direction while traveling along the driving rod.

16. The bed of claim 14, wherein the driving rod comprises a threaded portion and two non-threaded portion at both ends of the threaded portion, wherein the first and second traveling nuts are configured to travel along the driving rod while engaged with the threaded portion, wherein the first and second traveling nuts are configured to stop traveling when reaching the non-threaded portion.

17. The bed of claim 16, wherein the first traveling nut is configured to power hinged rotation of the first side section while traveling along the driving rod if the second traveling nut reaches the non-threaded portion.

18. A bed comprising:

a first frame comprising a first side section and a second side section, wherein the first and second side sections are formed at about the same level so as to in combination substantially evenly support a mattress thereupon;

a second frame underlying the first frame, wherein the first frame is configured to slide in a lateral direction of the bed relative to the second frame between a first position and a second position;

a sliding mechanism configured to power sliding of the first frame between the first position and the second position, wherein in the first position, the first frame substantially eclipses the second frame when viewed from the top, and wherein in the second position, a substantial portion of the second frame is exposed when viewed from the top;

a rotating mechanism configured to hingedly rotate the first side section about a longitudinal direction of the bed when the first frame is at the second position;

a center mattress comprising a first side edge and a second side edge, wherein in the first position of the first frame, the center mattress is placed over the first frame substantially eclipsing the second frame when viewed from the top; and a first side mattress depending from the center mattress along the first side edge of the center mattress, wherein in the first position of the first frame, the first side mattress is not supported by either the first frame or the second frame, whereas in the second position of the first frame, the first side mattress is supported by the second frame.

19. The bed of claim 18, wherein:

the first section comprising a first side rail, the second section comprising a second side rail, wherein the first side rail is arranged to be generally linear with the second side rail; and a lifting bar comprising a first lifting segment and a second lifting segment hingedly connected with the first lifting segment, wherein the first lifting segment and second lifting segment are configured to hingedly rotate relative to each other about a bending axis such that the first section and the second section hingedly bend relative to each other about the first axis, wherein the first lifting segment is engaged with the first side rail, wherein the second lifting segment is engaged with the second side rail, wherein the rotating mechanism is configured to lift the lifting bar, which causes to hingedly rotate the first side section about the longitudinal direction.

20. A method of operating a bed, comprising:

providing a bed comprising a first frame and a second frame underlying the first frame, wherein the first frame comprises a first side section and a second side section, wherein the first and second side sections provide a mattress support area configured to support a mattress, wherein the mattress support area has a width, which is a distance between two ends of the bed in a lateral direction;

sliding the first side section relative to the second frame in the lateral direction of the bed so as to vary the width throughout the bed's full length in a longitudinal direction that is perpendicular to the lateral direction; and rotating the first side section about a longitudinal direction of the bed when a substantial portion of the first side section is slid outwardly in the lateral direction relative to the second frame.

21. The bed of claim 18, wherein the first frame is further configured to slide relative to the second frame between the first position and a third position, wherein the sliding mechanism is further configured to power sliding of the first frame between the first position and the third position, and wherein in the third position, a substantial portion of the second frame is exposed when viewed from the top, and wherein the bed further comprises a second side mattress depending from the center mattress along the second side edge of the center mattress, wherein in the first position of the first frame, the second side mattress is not supported by either the first frame or the second frame, whereas in the second position of the first frame, the second side mattress is supported by the second frame.

22. The bed of claim 4, wherein in a third configuration of the bed, a substantial portion of the second frame is exposed when viewed from the top, and the bed has a third width, which is larger than the first width, and wherein the bed further comprises a second side mattress depending from the center mattress along the second side edge of the center mattress, wherein in the first configuration, the second side mattress is not supported by either the first frame or the second frame, whereas in the third configuration, the second side mattress is supported by the second frame.

23. The bed of claim 1, wherein the first and second side sections are configured to slide in the lateral direction such that the width of the bed varies throughout the bed's length in the longitudinal direction that is perpendicular to the lateral direction.

24. The bed of claim 1, further comprising a mattress piece placed on the first frame and substantially evenly supported by both the first side section and the second side section.

* * * * *